United States Patent [19]

Inuzuka et al.

[11] Patent Number: 4,538,902

[45] Date of Patent: Sep. 3, 1985

[54] IMAGE FORMATION APPARATUS

[75] Inventors: Tsuneki Inuzuka, Machida; Yoshihiro Kawatsura; Masato Ishida, both of Kawasaki, all of Japan

[73] Assignee: Canon Kabushiki Kaisha, Tokyo, Japan

[21] Appl. No.: 626,486

[22] Filed: Jul. 3, 1984

Related U.S. Application Data

[63] Continuation of Ser. No. 460,683, Jan. 24, 1983, abandoned, which is a continuation of Ser. No. 149,419, May 13, 1980, abandoned.

[30] Foreign Application Priority Data

| | | | |
|---|---|---|---|
| May 17, 1979 | [JP] | Japan | 54-60791 |
| May 17, 1979 | [JP] | Japan | 54-60796 |
| Jun. 8, 1979 | [JP] | Japan | 54-72617 |

[51] Int. Cl.[3] ..... G03G 15/20

[52] U.S. Cl. ..... 355/14 FU; 355/3 FU; 219/216

[58] Field of Search ..... 355/3 FU, 14 FU; 219/216, 501; 361/106; 340/527, 587

[56] References Cited

U.S. PATENT DOCUMENTS

| | | | |
|---|---|---|---|
| 3,735,092 | 5/1973 | Traiser | 219/216 X |
| 3,791,732 | 2/1974 | Mihalik et al. | 355/3 FU |
| 3,916,256 | 10/1975 | Kotani | 219/216 X |
| 3,985,433 | 10/1976 | Calvi | 355/14 FU |
| 4,006,985 | 2/1977 | Hutner | 355/3 FU |
| 4,007,456 | 2/1977 | Paige et al. | 340/527 X |
| 4,104,692 | 8/1978 | Sudo et al. | 361/106 |

FOREIGN PATENT DOCUMENTS

| | | | |
|---|---|---|---|
| 2816192 | 10/1979 | Fed. Rep. of Germany | 340/587 |
| 599057 | 6/1977 | Japan . | |
| 55-103575 | 8/1980 | Japan | 355/14 FU |
| 494755 | 3/1976 | U.S.S.R. | 340/527 |

*Primary Examiner*—R. L. Moses

*Attorney, Agent, or Firm*—Fitzpatrick, Cella, Harper & Scinto

[57] ABSTRACT

An image formation apparatus includes a device for forming an image on a sheet fed thereto, a fixing device for heat-fixing the image, a detector for detecting the temperature of the fixing device, a temperature controller for controlling the electric power supplied to a heat source in accordance with the detected temperature, a detector for detecting disconnection of an element in the temperature detector, and a controller for operating the disconnection detector after a predetermined time from a point of time at which the fixing device starts to be heated.

10 Claims, 23 Drawing Figures

IMAGE FORMATION APPARATUS

This application is a continuation of application Ser. No. 460,683 filed Jan. 24, 1983, now abandoned, which in turn is a continuation of application Ser. No. 149,419 filed May 13, 1980, now abandoned.

BACKGROUND OF THE INVENTION

1. Field of the Invention

This invention relates to an image formation apparatus such as a copying apparatus having various warning and display functions.

2. Description of the Prior Art

Particularly when a thermistor is brought into contact with a heat source to detect the temperature of the latter, the thermistor may be damaged by the rotation of the heat source or a lead wire supporting the thermistor may be broken. To avoid this, a method of protecting the surface of the thermistor by a heat-resistant tape or a method of bringing the thermistor into contact with the heat surface through a metal of springy property has heretofore been adopted. Recently, however, to reduce the actual space occupied by the temperature control, there is a tendency to miniaturize the thermistor itself and accordingly the lead wire of the thermistor and so, the danger of disconnecting or damaging the thermistor is increasing without any measure for preventing such disconnection or damage being proposed.

If temperature control is effected by a disconnected thermistor, the thermistor could not distinguish between the disconnected condition thereof and the low temperature condition of the detecting portion and would permit electric power to continue to be supplied to the heat source, thus causing abnormal temperature rise of the heat source. Such abnormal temperature in turn would cause deformation of a fixing roller as the movable part of the heat source or the heat-resistant resin on the surface of the fixing roller which would prevent smooth rotation of the fixing roller and accordingly normal fixation.

FIG. 17 of the accompanying drawings shows a circuit which may judge a difference in resistance value of the thermistor and detect disconnection thereof. This comprises a well-known bridge type temperature detecting circuit having added thereto a disconnection detecting bridge consisting of R6, R7, R3 and TH1, and is designed such that disconnection of the thermistor TH1 is detected by an operational amplifier Q2 to turn off a transistor Q3 and thereby turn off the power supply to a heater H1.

In this case, if electric power is not supplied to the entire apparatus including the heater for a long time and moreover the apparatus is left at a low temperature, then the thermistor TH1 would present a high resistance of the order of 10MΩ. The distinction between such high resistance and the high resistance resulting from a disconnection could only be realized either by using as the operational amplifier an operational amplifier of small offset and high input impedance or by increasing the voltage Vcc to detect a minute resistance variation in the form of a great potential difference. The former method not only requires the use of an expensive operational amplifier but also requires the provision of a counter-measure for noise and accordingly an extra device because a minute signal indicative of a disconnection is detected while being distinguished from the noise. In the latter method, the thermistor may be damaged by the thermistor current flowing when the temperature has become high and the resistance value of the thermistor has become low, and accordingly, the resistance value R3 must be determined so that the electric power of the thermistor does not exceed a rated loss power. However, such determination is very difficult and moreover, one more kind of Vcc voltage would be required and the power source would become complicated.

It is usual with copying apparatus that start of the copying is prevented until the fixing device reaches a predetermined temperature, but thereafter during the temperature control, the copying operation and the temperature control are rendered independent of each other. Accordingly, the thermistor may be disconnected to thereby cause abnormal temperature rise which may damage the copying parts as previously described.

Also, in a compact copying apparatus, elements such as semiconductor circuit elements which may be damaged by excessive heat are arranged in a crowded fashion and therefore, temperature rise in the interior of the apparatus resulting from disconnecting or over-heating of the thermistor would lead to destruction of the machine.

Particularly, in a transfer type copying apparatus having a small-sized photosensitive drum, the drum is disposed near the fixing device and thus, disconnection or over-heating of the thermistor would hasten deterioration of the photosensitive medium.

Also, copying apparatus are known which have the function of detecting and displaying whether or not the fixing device has reached the fixing temperature and the functions of detecting and displaying a deficiency of developer such as toner, deficiency of copy mediums such as transfer paper and jam of copy mediums.

In such apparatus, a display device is provided for each warning function and therefore, if it is desired to monitor the interior of the apparatus in every respect, a great number of warning display devices would be required and this, coupled with the necessity of providing a greater number of operating keys, would complicate the operating portion. Also, in the past, each display device has a single function of only effecting its exclusive warning display or only stopping the operation of the apparatus simultaneously with the warning and thus, it has been the case that the apparatus is stopped with inordinate frequency or that the smoothness with which the copying is restarted is hampered.

SUMMARY OF THE INVENTION

It is an object of the present invention to provide an image formation apparatus such as a copying apparatus which mitigates the above-noted disadvantages.

It is another object of the present invention to prevent, in a compact copying apparatus, the occurrence of a trouble or troubles which would result from disconnection of a sensor or over-heating of a fixing device, a lamp or the like.

It is still another object of the present invention to provide an image formation apparatus in which, even when the fixing device or the apparatus has been left at a low temperature condition for a long time, disconnection of a temperature detecting element can be distinctively detected without using an expensive element or circuit.

It is yet still another object of the present invention to prevent a disconnection detecting circuit from operating for a predetermined time at an initial stage while a heated member such as a roller starts to be heated and to permit the detecting operation to take place after the lapse of said predetermined time.

It is a further object of the present invention to minimize, in a compact copying apparatus, the number of warning display devices for detecting and displaying various troubles and material conditions.

It is a further object of the present invention to interrupt the image formation operation such as copying whenever the temperature controlling temperature detecting element in the fixing device or the like is disconnected or otherwise damaged and further, to permit the fact of the thermistor having been damaged to be displayed by the use of a display device for displaying the ready-to-copy condition.

BRIEF DESCRIPTION OF THE DRAWINGS

FIGS. 7-1 and 7-2 are diagrams of the control circuit in the apparatus of FIG. 1.

DESCRIPTION OF THE PREFERRED EMBODIMENTS

Figure 1:
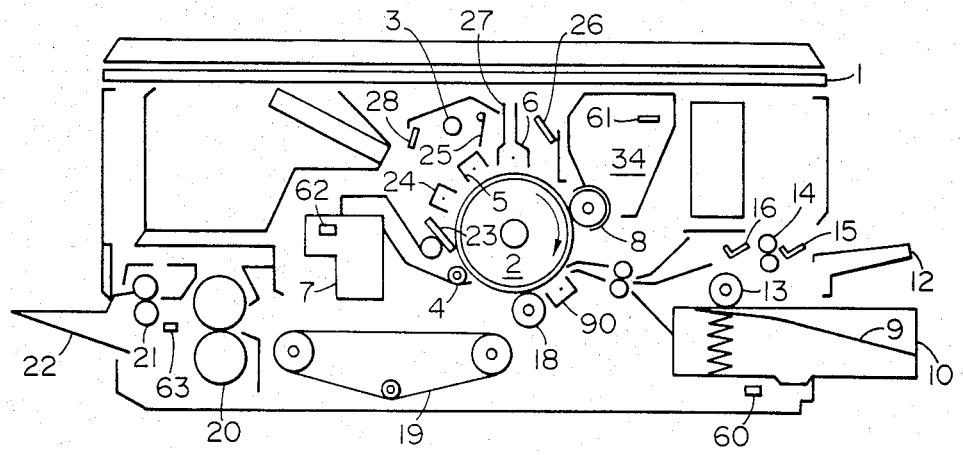
FIG. 1 is a cross-sectional view of the image formation apparatus according to the present invention.

Embodiments of the present invention will hereinafter be described with reference to the drawings. Referring to FIG. 1 which is a cross-sectional view of the copying apparatus according to the present invention, the copying apparatus includes a reciprocable platen 1 for supporting an original thereon, a rotatable drum 2 having a seamless photosensitive medium on the periphery thereof, a lamp 3 for exposing the drum 2 to the original image on the platen 1, a corona charger 5 for precharging the surface of the photosensitive medium to the positive polarity, a corona charger 6 for discharging the surface of the photosensitive medium to the negative polarity with the exposure image, a developing device 8 for developing an electrostatic latent image, a charger 9 for transferring the developed image to transfer paper 10, a cassette 11 containing a number of sheets of transfer paper 10 therein and removably mounted on the apparatus body, a bed 12 for manually supplying transfer paper 10, a roller 13 for feeding the transfer paper from the cassette, a pair of rollers 14 for feeding the transfer paper from the manual supply bed 12, microswitches 15 and 16 for detecting the manually supplied transfer paper, a pair of register rollers 17 for registering the leading end of the transfer paper to the leading end of the image on the drum, a roller 18 for separating the transfer paper from the drum, a belt 19 for conveying the transfer paper, fixing rollers 20, rollers 21 for discharging the transfer paper into a tray 22, a blade cleaner 23 for removing any remaining toner from the drum, a magnet roller 4 for collecting the toner removed by the blade 23, a container 7 for containing the toner collected by the roller 4, a minus corona charger 24 for removing any remaining charge on the drum, a shutter 25 for imparting the light from the exposure lamp 3 directly to the exposured surface of the drum for a predetermined time, mirrors 26 and 28 for imparting the light from the lamp 3 directly to the surface of the drum, and a cellfock lens 27 for causing the light of the lamp 3 reflected from the original to be imaged on the surface of the drum.

Operation will now be described. When a main switch is closed, a motor for driving the drum 2 is energized and the lamp 3 is turned and the shutter 25 is opened while, at the same time, the corona charger 6 is energized and the drum 2 is rotated. Thereby, the drum surface is pre-cleaned to remove any remaining toner and charge and memory therefrom. When the fixing rollers 20 is heated to the fixing temperature by an internal heater, a copy signal is generated. Where a copy switch is not closed or where a sheet is not manually inserted, the drum still continues to rotate thereafter and, when a predetermined number of pulses from a rotary encoder provided in the drum driving system and adapted to generate n pulses for one full rotation of the drum are counted, the drum is stopped from rotating. The above-described drum rotation is referred to as the first pre-rotation.

When the copy switch is closed or a sheet is manually inserted during the rotation or the stoppage of the drum, the shutter 25 is closed and the drum 2 makes substantially one full rotation (hereinafter referred to as the second pre-rotation), whereafter the platen 1 starts its forward movement and the original on the platen 1 begins to be slit-exposed. The drum is slit-exposed to the reflected image of the original through the cellfock lens. The photosensitive medium of the drum comprises, in succession from the surface thereof, an insulating layer, a photoconductive layer and an electrically conductive layer and, when the surface charged by the charger 5 reaches an exposure surface, plus charge is removed by the minus charger 6 and the optical image. When that surface reaches an uniform exposure surface, an electrostatic latent image of high contrast is formed on the drum surface by the light from the mirror 26. The latent image receives toner at the developing area and is developed into a visible image. The visible image is transferred to transfer paper at the image transfer area by the plus potential of the image transfer charger. The transfer paper is one which has been fed there by the timing operation of the paper feed roller 13, and passes through the image transfer area at the same velocity as the peripheral velocity of the drum with the aid of the register rollers 17. After the image transfer, the transfer paper is separated from the drum by the roller 18 and conveyed to the fixing rollers 20 by the belt 19, whereby the image on the transfer paper is fixed, where after the transfer paper is discharged into the tray 22 by the roller 21. After completion of the image transfer, the drum surface is cleaned by the blade 23 and discharged by the charger 24 and the memory thereon is removed by the light from the lamp 3 through the mirror 28.

Where continuous copying is effected from the same original, the platen 1 repeats its reciprocal movement over a number of times set by copy count keys of the apparatus operating portion.

Figure 2:
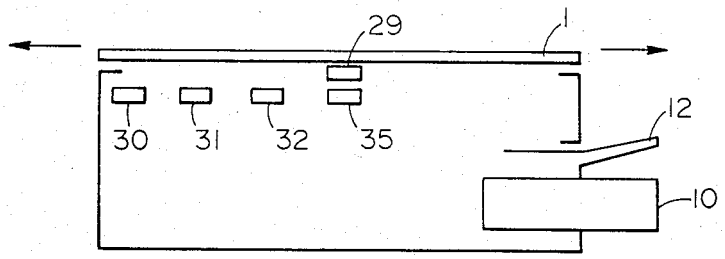
FIG. 2 is a cross-sectional view of the original platen portion of FIG. 1.

FIG. 2 shows a portion around the platen. The platen has a magnet 29 thereon, and reed switches 30, 31, 32 and 35 adapted to be actuated by the passage of the magnet are disposed on the movement path of the platen. When the magnet actuates the reed switch 35, the platen is stopped at its initial position in the center of the body, and when the magnet actuates the reed switch 30, the platen is changed over to the rightward or forward movement for the exposure. The switch 31 is for feeding paper by the paper feed rollers 13 and 14, and the switch 32 is for feeding paper by the register rollers 17. In the case of continuous copying, when the first slit scanning is terminated and the platen is backwardly moved to actuate the switch 30, the platen again starts its forward movement and effects the second scanning. In this manner, a set number of copies are obtained. The lamp 3 and simultaneous charger 6 are turned on in synchronism with the rotation of the main motor, namely, the drum, and the primary charger 5 and precharger 24 are turned on except during the post-rotation cycle. The lamp 3 is controlled so as to emit a high intensity of light during the scanning movement of the platen.

In the case of the manual supply copying, when a sheet is inserted from the bed 12, the detector 15 detects the sheet. Then, the feed rollers 14 are operated to introduce the sheet into the apparatus. However, the rollers 14 are not operated for a predetermined time (about two seconds) after the detector 15 has detected the sheet. This time allowance is for preventing oblique insertion of the sheet or for correcting the sheet to straight movement or enabling the sheet to be replaced by another one. When that time has elapsed, the rollers 14 are operated and also the drum 2 is rotated to carry out a process sequence similar to that in the case where the copy switch is closed. The drum 2 starts the second pre-rotation as soon as the detector 15 detects the sheet, whereby the copy starting time can be quickened. Also, when the sheet insertion is detected by the detector 15, the feeding of sheets from the cassette is stopped. In the manner described above, copying can be started simply by inserting a sheet without closing the copy switch of the operating portion, and the sheet is fed into the apparatus while maintaining an accurate sheet position, so that toner image can be transferred to the sheet at a predetermined location thereof and jam of the sheet can be prevented.

When the switch 16 detects that the trailing end of the sheet has passed this switch, the rollers 14 are stopped, thus becoming prepared for the insertion of the next sheet.

Figure 13:
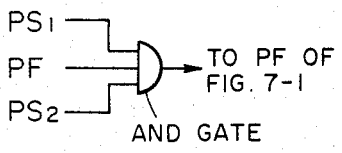
FIG. 13 is a diagram of another circuit concerned with sheet feeding.

Now, a plurality of such detectors 15 may be provided at a right angle to the direction of feed of sheet. These are for detecting oblique movement of a sheet and the rollers 14 are not operated until both of the detectors detect a sheet. Also, design may be made such that the second operation of the rollers 14 takes place only when there are outputs of both of the detector 15 and detector 16, as shown in FIG. 13. Thereby, jam can be prevented.

Figure 3:
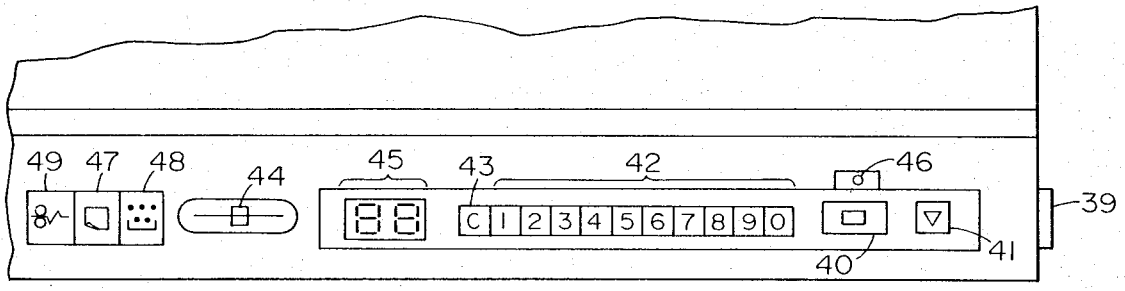
FIG. 3 is a fragmentary plan view of the FIG. 1 apparatus.

FIG. 3 is a plan view of the operating portion of the FIG. 1 copying apparatus. It includes a main switch 39, copy start copy count keys switch 40, a stop key switch 41 for interrupting continuous copy, a ten key 42 for causing a number to be stored in a memory to set the number of continuous copies to be made, a clear key 43 for clearing the number stored in the memory, a copy gradation setting lever 44, a 7-segment displayer 45 for the memory number, a wait lamp 46 adapted to be turned on for display until the fixing temperature is reached, a lamp 47 for displaying the absence of the cassette and of sheets in the cassette, and a lamp 48 for displaying when the container 7 for collecting the used toner by the cleaner is filled with such toner. Designated by 49 is a displayer for displaying when a sheet jams. When a sheet is jamming, the clear key and the ten keys are not operated, but during the waiting, these keys are operable.

The segment displayer 45 displays a zero-suppressed 1, irrespective of the waiting, upon closing of the main switch 39, displays the set number minus 1 upon termination of each copy, and again displays the set number upon completion of the set number of copies and thereafter. When 30 seconds elapses without the copying being started, it again displays 1. Thereby, one-sheet copying can be started without the number setting by the ten keys and the re-start of the copying can be executed smoothly.

The wait displayer 46 is turned on and off by the closing of the main switch 39, and is statically turned on when the temperature of the fixing rollers is not reduced below the fixing temperature, namely, when a short time has elapsed after the previous operator has opened the main switch 39, but is turned on and off when the temperature of the fixing rollers is below the fixing temperature (wait). The wait displayer is turned on also when the waiting time has elapsed after the fixing rollers have risen to the fixing temperature. When the main switch is opened, both the turn-on-and-off and the turn-on condition are extinguished and the wait displayer displays the main switch off condition. Further, when the copy switch is closed after wait-up, turn-on-and-off operation having a longer turn-on-and-off interval than that during the waiting is effected until the mode shifts to the post-rotation mode. That is, a single wait displayer can display four conditions, namely, the closed main switch condition, the wait condition during which copying is impossible, the read-to-copy condition, and the copy cycle and thus, the number of displayers can be saved and this contributes to reduced cost of the apparatus.

An overflow displayer 48 detects and displays the overflow condition of the container 7 and also detects deficiency of toner in the developer container 33, whereupon it is statically turned on for display. In the former case, a lamp may be turned on and off and in the latter case, the lamp may be statically turned on.

The paper absence displayer 47 may be turned on and off in case of the absence of paper, and may be statically turned on in case of the absence of the cassette.

Also, when toner deficiency in a hopper 33 or the overflow of the collecting container 7 is detected and where the continuous copying for the number of sheets set by the ten keys is being executed, the copying is continued until the set number of copies is completed and thereafter, re-start of the copying is prevented. Thus, the display for warning is effected, but the copying is not immediately interrupted to make the series of copying operations stop and slow the copying speed, because even if the toner is deficient or overflow takes place, the image will not be suddenly degraded nor will the apparatus will be contaminated. When transfer paper jams, the operation of the apparatus is immediately stopped to secure the safety of the apparatus. For the stop key, paper absence and cassette absence signal, the operation of the apparatus is not immediately interrupted but the process cycle then being executed is permitted to be completed, whereafter the start of the subsequent cycle is prevented.

Figure 4:
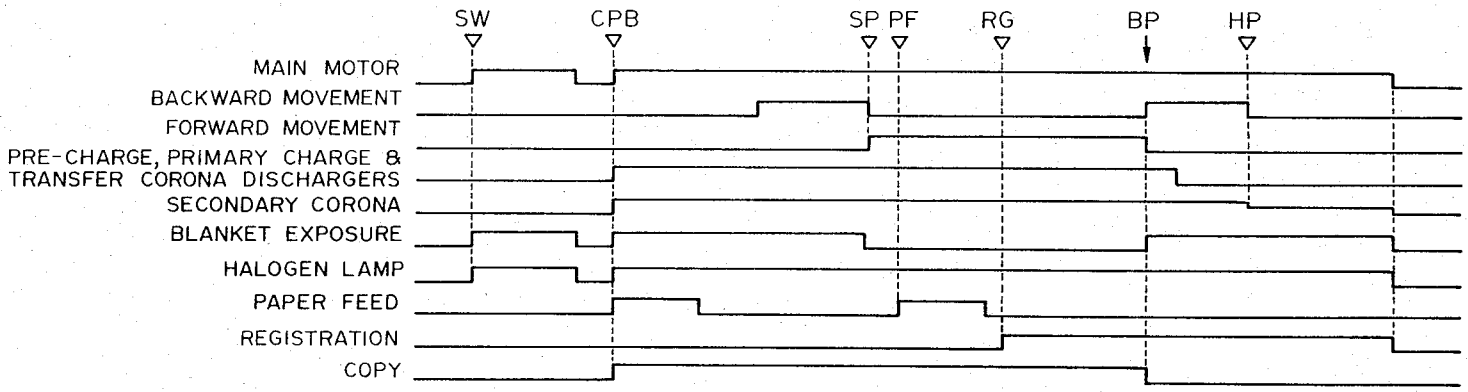
FIG. 4 is an operation timing chart for the apparatus of FIG. 1.

With reference to FIG. 4 which is an operation timing chart of the copying apparatus of FIG. 1, the operation sequence of scanning and the operation timing will be described in detail.

Before the copy switch 40 is closed, the platen 1 is positioned centrally of the body as shown in FIG. 1. When the copy switch 40 is closed, the pre-discharging charger 24, the lamp 3, the primary charger 5, the secondary charger 6, the image transfer charger 9 and the shutter 25 are energized, so that pre-corona, primary corona, secondary corona, image transfer corona, pre-discharging exposure, blanket exposure and uniform exposure are imparted to the photosensitive medium, which thus becomes ready to start copying. The lamp 3 is turned on with weak light.

When said predetermined number of pulses are counted, namely, when the drum makes a predetermined rotation, the platen 1 begins to move from the position of FIG. 1 to the left, and thereafter when the drum has made substantially one full rotation, the switch 30 is closed and therefore, the platen is stopped, and then starts to move rightwardly for exposure. The lamp 3 is now turned on with intense light and the shutter is deenergized to stop the blanket exposure and effect the exposure. The blanket exposure is an exposure whereby, when image exposure is not taking place, light is applied to the image-exposed surface so as to prevent occurrence of irregularity in the potential on the photosensitive medium. Also, by changing over the lamp between the intense light and the weak light, various process exposures can be appropriately accomplished by a single lamp.

After image exposure has been done over substantially one full and half rotation, the movement of the platen 1 is stopped and then the platen is moved to the left. The start of this movement is effected by counting said predetermined number of pulses, and the number set in the memory is set in a register for a copy counter and 1 is subtracted from that number. As a result, the content of the register becomes 0 in case of a single sheet copy and thus, the re-start of the subsequent copying cycle is prevented. During this rightward movement, the reed switch 31 of FIG. 2 is actuated to operate the paper feed roller 13 or 14 and the reed switch 32 is actuated to operate the register roller 17, thereby feeding a sheet. Even if the reed switches 31 and 32 are actuated during the platen movement at a time other than exposure, the rollers 13, 14 and 17 will not be operated.

When the platen 1 actuates the switch 35 in its initial position, it is stopped from moving. Then, the lamp 3 is controlled to its weak intensity and the shutter is operated to start the blanket exposure by the weak turn-on of the lamp 3. Thereafter, the drum rotation is continued so that the photosensitive medium is electrically and mechanically cleaned and, after substantially one full rotation of the drum, the process load as shown in FIG. 4 is removed and the drum rotation is stopped. After this stoppage, the main switch on condition is continued.

In the case of continuous copying, even if the switch 35 is closed, the platen 1 is not stopped but continues to move leftwardly and when it actuates the switch 30, rightward movement of the platen 1 is again started and turns on the lamp 3 with intense light and deenergizes the shutter, thus re-starting the image exposure.

In the present embodiment, one cycle of exposure scanning is effected with the platen being changed twice in its direction of movement and therefore, as shown in FIG. 1, the platen can be set at the center during stoppage of the copying. Also, copies of a full size corresponding to the body size can be produced and this leads to compactness of the machine. Moreover, the control of the two changes in direction is effected by the platen position switches and pulse count timer and this eliminates the necessity of providing a complicated spring mechanism for changing the direction. Further, the reed switch 35 is provided with a plurality of functions which will later be described and thus, any cumbersomeness caused by the reed switch which would otherwise detract from the compactness of the machine may be prevented.

The time whereat the rightward movement for exposure should be stopped and the direction of movement should be changed is determined in accordance with the size of sheets in the cassette 10 and the size of the sheet manually supplied from the manual supply bed 12.

Some of the foregoing and the following embodiments of the present invention are also applicable to copying apparatus which have a first mirror movable at a velocity of V and a second mirror movable at a velocity of $(\frac{1}{2})V$ and in which exposure scanning is effected by reciprocal movement of these mirrors, and are also applicable to copying apparatus in which a roll of paper is cut into the length of the size carried on the platen and the paper thus cut is automatically fed, or to copying apparatus in which the latent image on the drum is transferred to a sheet and such sheet is developed. The present invention is also applicable to copying apparatus in which a copy image is directly formed on a sheet without the intermediary of a drum or to copying apparatus in which other data than an original document is printed on a sheet.

Figure 5:
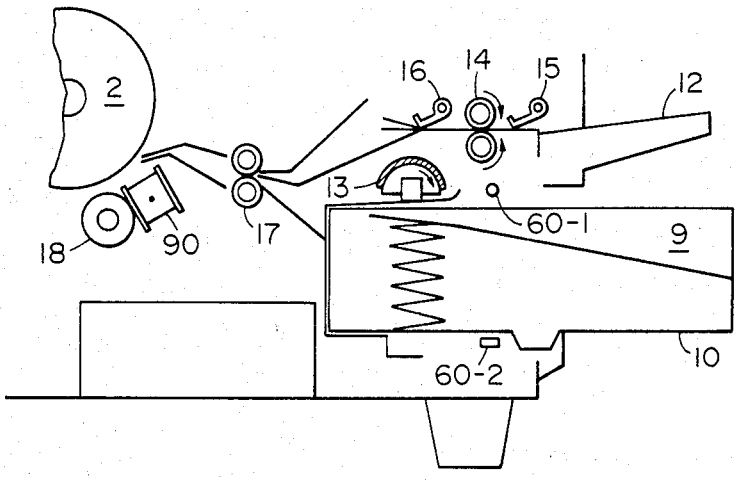
FIG. 5 is a cross-sectional view of the sheet feeding portion of the FIG. 1 apparatus.
Figure 6:
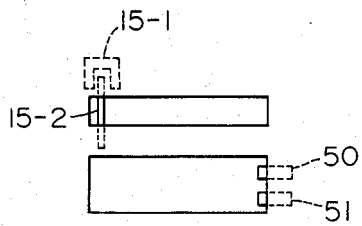
FIG. 6 is a right-hand front view of the portion shown in FIG. 5.

FIG. 5 is a vertical cross-sectional view of the cassette portion and manual supply portion, and FIG. 6 is an elevational view thereof. Designated by 15-1 is a photointerrupter constituting a manually supplied sheet detector 15, denoted by 15-2 is an actuator piece swingable upon insertion of sheet, and designated by 50 and 51 are microswitches adapted to be actuated by a cam provided on the cassette when the cassette is mounted in the apparatus body. When both of the switches 50 and 51 are in OFF position, there is generated a signal meaning the absence of a cassette; when the switches 50 and 51 are in ON and OFF positions, respectively, there is generated a signal meaning the presence of a cassette having sheets of the half-size, namely, A4 or B5 size; when the switches 50 and 51 are in OFF and ON positions, respectively, there is generated a signal meaning the presence of a cassette having sheets of B4 size; and when both of the switches are in ON position, there is generated a signal meaning the presence of a cassette having sheets of the full-size, namely, A3 or B4 size. The three different signals for these sizes are used to determine the exposure stroke of the platen 1.

With regard to manually supplied sheets, the full-size includes B4 size and so, the two sizes, i.e. the half-size and the full-size are detected by the sheet detector 15.

Accordingly, where sheets are continuously fed from the cassette to execute the production of multiple copies, the copying cycle is repeated at a stroke corresponding to each size, namely, in a minimum time, whereby the time required for the copying can be reduced. This, coupled with the aforementioned effect of making sheet pick-up for the next sequence prior to the completion of the present sequence to thereby reduce the copying interval, provides an excellent merit. However, in the case of manual sheet supply, it is rare that sheets are continuously fed and therefore, two series of stroke controls suffice and this leads to simplification of the control circuit and reduced malfunctioning related to the size detection.

The actuator piece of the sheet detector 15 is provided at the left end, as is shown in FIG. 6. This position corresponds to a belt provided outside of the image formation area of the drum to separate transfer paper from the drum after image transfer. This enables judgement as to whether or not a manually supplied sheet has been inserted into a separable predetermined position.

Figure 11:
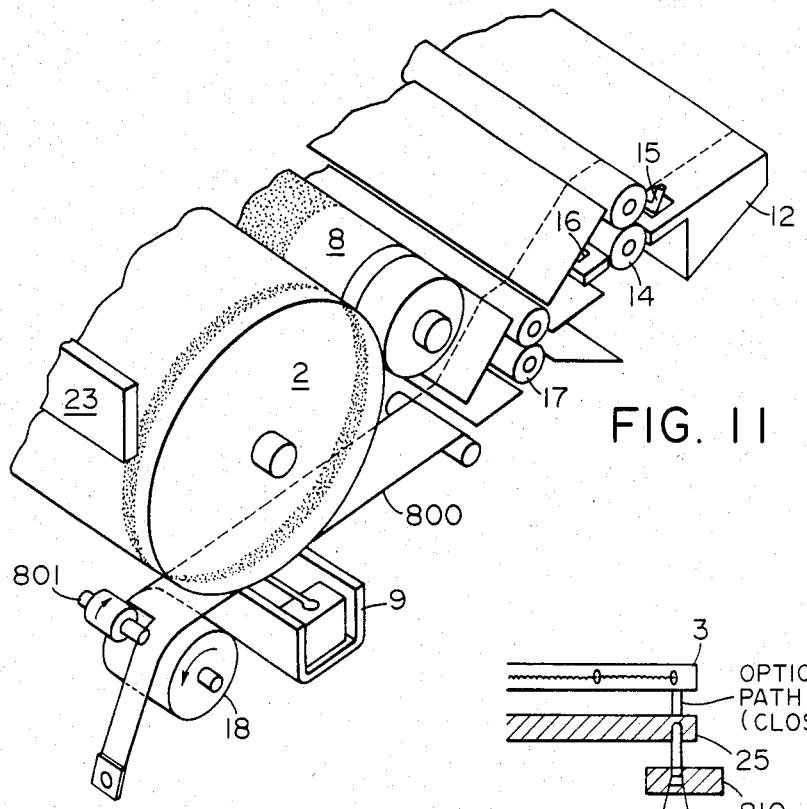
FIG. 11 is a perspective view of the separating portion.

FIG. 11 is a perspective view showing portions adjacent to the image transfer and separating station. Reference numeral 800 designates a fixed separating belt, and reference numeral 801 designates a keep roller. A sheet fed from the register rollers 17 moves with its left end portion passing under the belt 800 and the sheet contacts the moving drum due to the electrostatic attraction between it and the drum, whereby toner image is transferred to the sheet with the aid of the corona charger 9. The sheet having the toner image transferred thereto passes between the roller 18 and the belt 800 while being held down by the roller 801, and is separated from the drum. If the manually supplied sheet detector 15 or 16 is provided at a position corresponding to this belt 800 with respect to the direction of movement of the sheet on its path, the insertion of the manually supplied sheet can be detected by a single detector and also appropriate position setting of the sheet can be accomplished.

Figure 12:
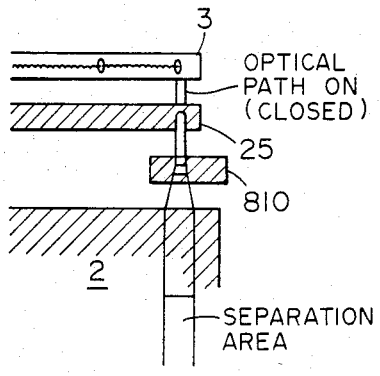
FIG. 12 is a plan view of the drum in the exposure portion.

FIG. 12 is a fragmentary plan view of the drum, in which reference numeral 810 designates a sharp cut window for preventing adherence of toner in the separation width portion.

During the forward movement of the platen, the light from the original illuminating lamp 3 is applied through the sharp cut exposure window 810 to that portion of the drum which is in contact with the separating belt 800. Thus, the charge in that portion is erased to prevent adherence of toner and the separation width portion is secured. This is irradiated with light through a slit of the shutter portion and a fixed window to expose the shutter 25 to light even during the closed condition of the shutter 25. Accordingly, the sheet detectors 15 and 16 are provided so as to correspond to the belt 800 and the sharp cut optical path.

The sheet detector 16 is provided at the same left end position as the sheet detector 15 with respect to the photosensitive medium. This detector 16 has the following three functions. A first function is to detect the size of a manually supplied sheet and when the detector 16 does not detect a sheet at a predetermined time, the size of the sheet is judged as the half-size and when the detector 16 detects a sheet at the predetermined time, the size of the sheet is judged as the full-size. A second function is to render the length of the path from the leading end of a manually supplied sheet to the register rollers equal to the length of the path from the cassette sheet. Also, where the path to the register rollers is relatively long, the flexure of the sheet formed by the sheet striking against the register rollers is not always constant so that the image transfer registration is sometimes unstable. This can be prevented. That is, when the detector 16 detects a sheet fed by the manual supply rollers 14, these rollers 14 are deactivated after a predetermined time and wait while becoming prepared to feed the sheet to the register rollers. The rollers 14 are again operated by the signal from the reed switch 31 and being to feed the sheet to the register rollers. A third function is to stop the rollers 14 when the detector 16 detects the trailing end of the sheet, and to become prepared for the next sheet.

The operation of the sheet detector 15 detecting a sheet to operate the rollers 14 and of the sheet detector 16 detecting that sheet to deactivate the rollers 14, namely, the preparatory feeding and waiting, is for preventing the function of the register rollers from being damaged and more particularly, for ensuring the mountain of the loop (flexure) of the sheet formed by the sheet striking against the stopped register rollers to be kept down to a suitable range. Accordingly, there is no possiblity of sheets being broken or jamming. Moreover, this is accomplished by a single roller, which leads to ease and lower cost with which the machine is made compact.

This also holds true with the paper feed from the cassette. That is, the paper feed roller 13 is operated for a little time by the closing of the copy switch to pull out a sheet from the cassette, and then the feed roller 13 waits. The reed switch 31 starts to feed the so pulled out sheet until the sheet reaches the register rollers.

Figure 14:
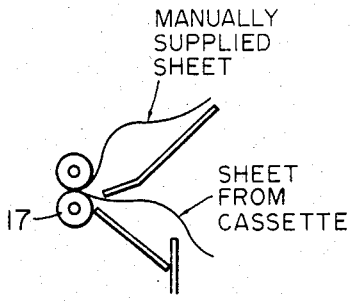
FIG. 14 shows the flexure of a sheet.

FIG. 14 shows the form of a sheet near the register rollers 17. The cassette roller 13 is of a semicircular cross-section and makes a half rotation to effect preparatory feeding, and makes a further half rotation to effect main feeding.

The present embodiment, as described above, is an image transfer type copying apparatus which is constructed by using the image scanning system provided by the reciprocal movement of the seamless photosensitive drum 2 and the platen 1 and the image exposure system for the drum provided by the cellfock lens 27, namely, the one-to-one magnification bar lens and in which the construction is improved for the purposes of further compactness, higher performance and lower cost. That is, the copying apparatus of the present embodiment has been made compact with the copy interval reduced and with the image transfer registration well maintained by the control for the change-over of the optical path by using a single lamp for various exposures, the sheet feed control for preventing an increase in number of timing rollers in the sheet path, and the smooth control of changes in direction of the platen by low-cost means. Moreover, in the construction of the present embodiment, the copy size is not fixed, two series of feed paths are provided so as not to restrict the types of copy sheet, malfunctioning is eliminated and sheet jam can be minimized. If the cellfock lens 27 is provided in a space forming the shortest distance between the drum 2 and the platen 1, as shown in FIG. 1, it will be very effective to make the apparatus compact.

(Controller)

Figures 1, 7:
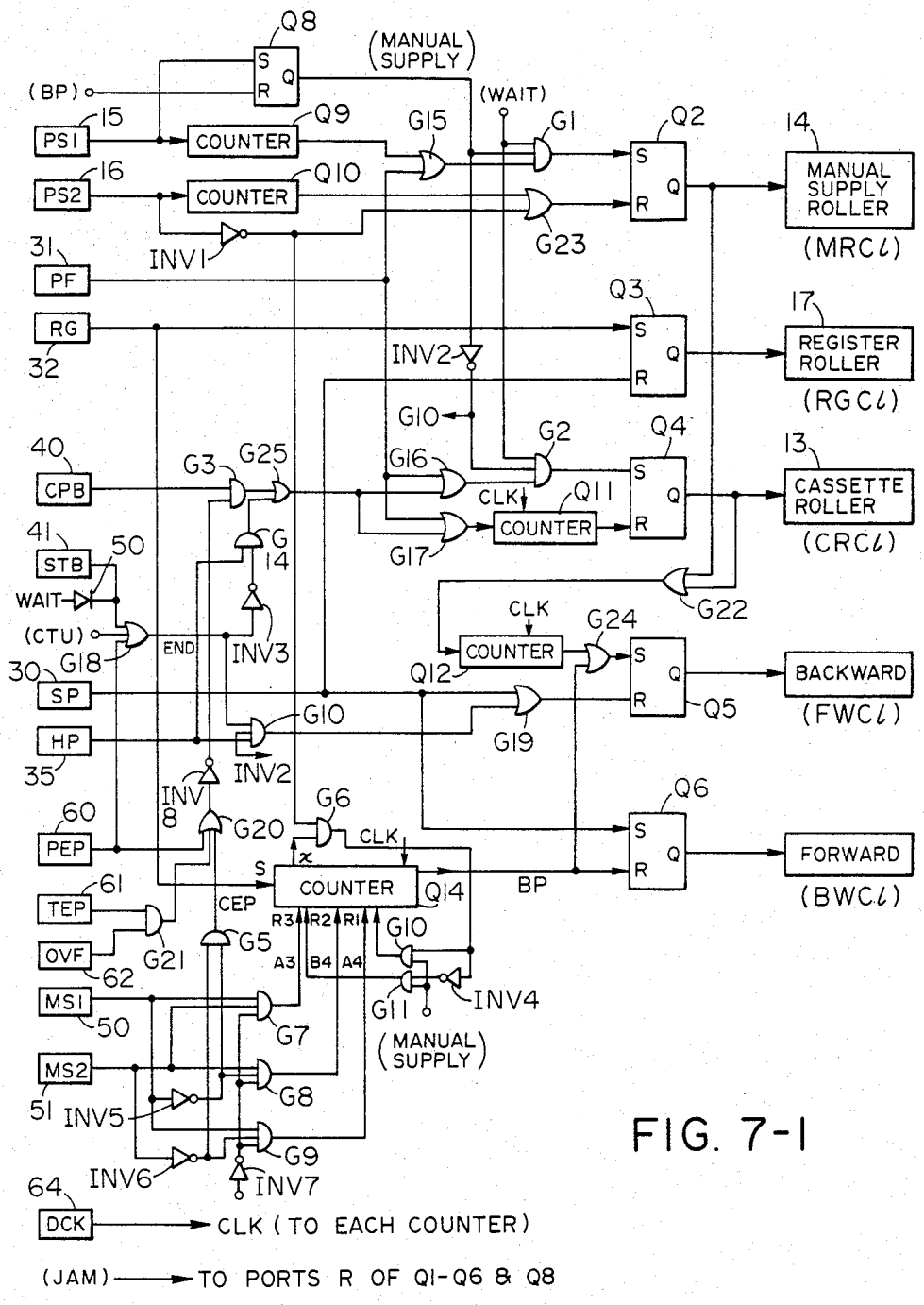
Figures 2, 7:
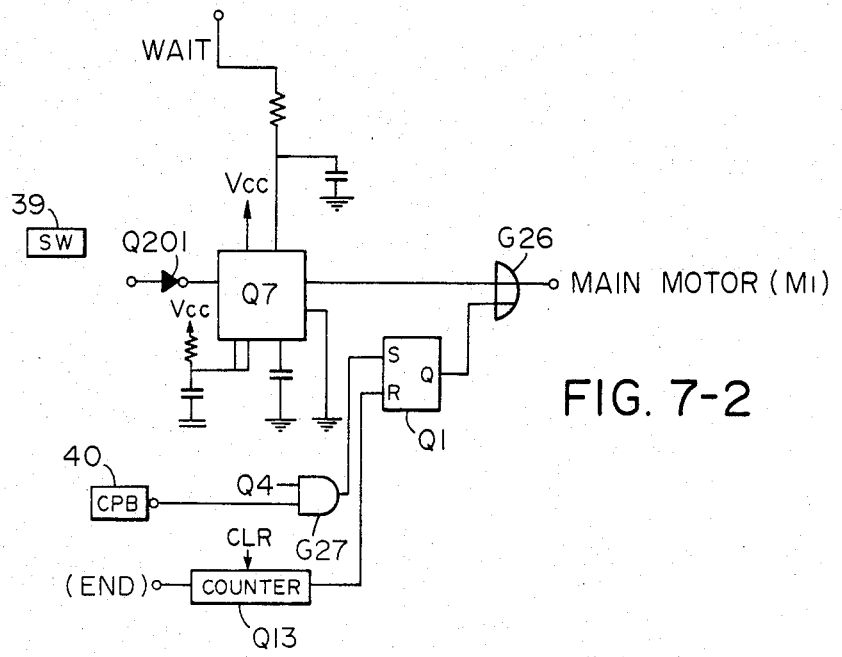
Figure 8:
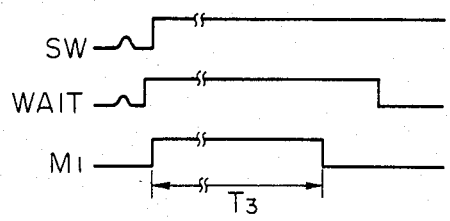
FIG. 8 is a control timing chart for the circuit shown in FIG. 7-2.
Figure 9:
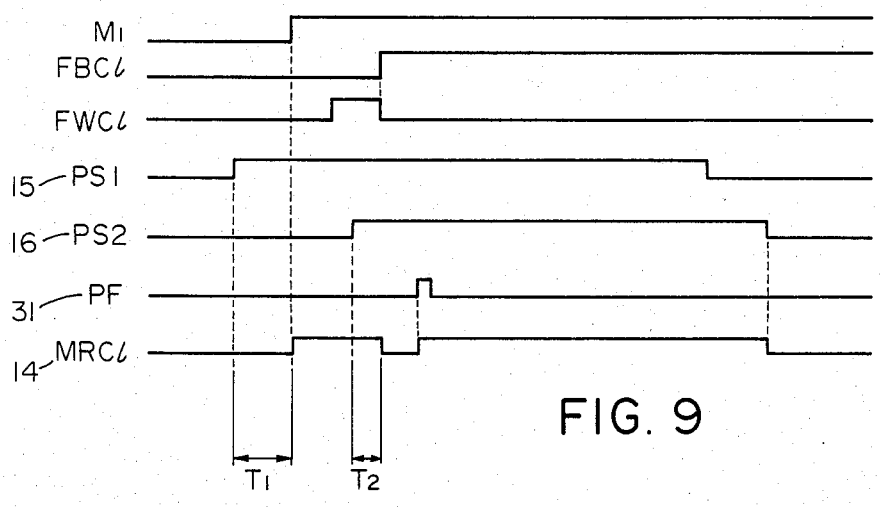
FIG. 9 is a control timing chart for the circuit shown in FIG. 7-1.

FIG. 7 is a diagram of the operation control circuit of the FIG. 1 copying apparatus. $Q_1$–$Q_6$ designate flip-flops for operatively controlling a main motor (which operates the drum 2, various rollers and the belt 19), a clutch for operating the manual supply rollers 14, a clutch for operating the register rollers 17, a clutch for operating the cassette roller 13, a clutch for backwardly moving the platen 1, and a clutch for forwardly moving the platen 1. The flip-flops $Q_1$–$Q_6$ are switched on by a pulse rising signal to a port S, and switched off by a pulse rising signal to a port R. $Q_7$ designates a one-shot for effecting the wait control of the main motor and it generates an output of time limit $T_3$ as shown in FIG. 8 after the closing of the main switch. $Q_8$ designates a flip-flop for judging the manual supply mode and the functions of the ports S and R thereof are identical to those of the flip-flop $Q_1$ except that it is not an edge trigger. $Q_9$ denotes a timer for operating the manual supply rollers 14 and generating an output after a time limit $T_1$ as shown in FIG. 9, and it is operable on condition that an input signal shall be ON for the time $T_1$. That is, the timer $Q_9$ can complete its timer operation as long as there is an input signal, and cancels its timer operation when the input signal disappears. $Q_{10}$–$Q_{13}$ denote counters for counting clock pulses generated by the drum rotation from the point of time whereat the input signal has been entered and for generating a pulse output when the count reaches a predetermined count number. The counters $Q_{10}$ and $Q_{11}$ are for determining the deactivation of the manual supply rollers and of the cassette roller, and the counters $Q_{12}$ and $Q_{13}$ are for determining the number of pre-rotations and the number of post-rotations. N (a predetermined number) clock pulses DCK are generated at equal intervals per full rotation of the drum by the aforementioned rotary encoder. $Q_{14}$ is a counter similar to the counters $Q_{10}$–$Q_{13}$, but in case of the cassette mode, it selects a preset number in accordance with the size of the cassette and in case of the manual supply mode, it selects a preset number in accordance with the size of a manually supplied sheet in a mode different from the cassette mode. The counter $Q_{14}$ for controlling the stroke of the platen. $G_1$–$G_{10}$ designate AND gates, $G_{13}$–$G_{23}$ denote OR gates, and $INV_1$–$INV_6$ designate inverters.

Signals $M_1$, MRCl, RGCl, CRCl, FWCl and BWCl are the signals for operating the main motor, the manual supply roller, the register rollers, the cassette roller, the forward movement of the platen and the backward movement of the platen when these signals are 1, and for deactivating these members when the signals are 0; CLK is a clock pulse; BP is a signal for reversing the platen; and END is a copy cycle interrupting signal provided by signals STB, CTU, PEP and CEP for the stop key, count up, and paper/cassette absence. "Manual Supply" is a signal indicative of the manual supply mode; JAM is a signal indicative of sheet jam and generated upon detection of jam; CTU is a count-up signal of the copy counter indicative of a preset number of copies having been completed; and SW is a main switch on signal put out upon detection of the condition of the switch SW. $PS_1$ and $PS_2$ are signals put out when a manually supplied sheet is detected by the detectors 15 and 16; PF and RG are respectively a paper feed signal and a registration signal generated when the platen has actuated the reed switches 31 and 32 as aforementioned; CPB and STB are signals generated when the copy button and stop key of the operating portion are operated; and SP and HP are signals generated when the platen has actuated the reed switches 30 and 35 and indicative respectively of the platen forward movement start position and stop position. PEP is a signal put out when the emptiness of the cassette 10 has been optically detected by a lamp 60-1 and a light-receiving member 60-2, and CEP is a signal indicative of removal of the cassette 10 and put out by microswitches 50 and 51 operatively controlled by the cassette ON. TEP is a signal indicative of the absence of toner in the developing device 34 and put out when it is detected by a toner level detector 61 in the developing device that the level of the toner has lowered below a predetermined level, and OVF is a signal indicative of the overflow condition of the collected toner in the collecting container 7 and put out when the overflow is detected by a level detector 62. WAIT is a signal indicative of the wait condition and put out by a thermistor Th which detects the temperature of the fixing roller.

Operation will now be described. During the duration of the wait signal WAIT generated upon closing of the main switch 39, the one-shot $Q_7$ of FIGS. 7–2 is operated and a main motor signal $M_1$ is put out through the gate $G_{26}$ for a time $T_3$ to effect a first pre-rotation of the drum. Thereafter, if the copy button is depressed when the wait is up (WAIT is 0) and standby has come, the flip-flop $Q_1$ is set and likewise the main motor is energized to start the process.

(Cassette Mode)

Now no sheet is being inserted from the manual supply bed 12 and therefore, the detector 15 is OFF. Accordingly, the flip-flop $Q_8$ is OFF, a manual supply signal is not put out, the gate $G_1$ is OFF-controlled and the flip-flop $Q_2$ is not set. Thus the manual supply rollers 14 are not operated.

Assuming that paper is absent and toner is absent and no overflow is occurring, start signal is entered into the gate $G_2$ through the gates $G_3$, $G_{25}$ and $G_{16}$ upon depression of the copy key. Since wait and manual supply reversing signals (all being 1) are applied to the other port of the gate $G_2$, the flip-flop $Q_4$ is set on and the clutch of the cassette roller 13 is engaged. While the counter $Q_{11}$ is effecting a predetermined pulse count through the gate 17, the roller 13 makes a half rotation and stops, thereby pulling out substantially one half of a sheet from the cassette and stopping the sheet. By this, the difference between the time from the copy start until image transfer and the time required for the movement of the sheet, which difference would occur where the drum is small, can be corrected.

Upon the output of this flip-flop $Q_4$, the count CLK of clock pulses is started by the counter $Q_{12}$ through the gate $G_{22}$. A predetermined number of pulses counted corresponds substantially to one full rotation of the drum, and the flip-flop $Q_5$ is set through the OR gate $G_{24}$ to put out signal FWCl, which moves the platen leftwardly. When the platen actuates the reed switch 30, the flip-flop $Q_5$ is reset through the gate $G_{19}$ to disengage the clutch FWCl while the flip-flop $Q_6$ is set to put out clutch signal BWCl, which moves the platen rightwardly. The image exposure lamp 3 is turned on and controlled in synchronism with the main motor $M_1$, and the quantity of light thereof is controlled in synchronism with the control of this BWCl so that the light is intense when BWCl is ON. The reset time of the flip-flop $Q_6$ for terminating the first slit exposure is determined by cassette switches 50 and 51.

That is, when the switches 50 and 51 are 1 and 0, respectively, sheets of size A4 are contained in the cassette and therefore, the exposure stroke is terminated at that width. That is, the preset number of the counter $Q_{14}$ which counts clock pulses and determines the reversing position is determined to n1 which is suited for A4. In case of size B4 sheets, the switches 50 and 51 are 0 and 1, respectively, and therefore, n2 greater than n1 is preset. In case of size A3 sheets, the switches 50 and 51 are 1 and 1 and therefore, n3 which is greater than n2 is set. When the switches 50 and 51 and 0 and 0, cassete absence signal CEP is put out through the gate $Q_5$.

The counter $Q_{14}$ effects a pulse count after the register switch 32 has been closed and, when the count reaches the aforementioned number n1–n3, the counter puts out BP to reset $Q_6$ and terminate the forward movement. On the other hand, $Q_5$ is set by BP through the gate $G_{24}$ to move the platen leftwardly and, when the platen actuates the reed switch 35, $Q_5$ is reset to stop the backward movement.

Now, when the switch 31 is closed in the course of the forward movement of the platen, signal PF is applied to the gates $G_1$, $G_2$ and counter $Q_{11}$ through the gates $G_{15}$, $G_{16}$ and $G_{17}$. Since the gate $G_1$ is OFF as aforementioned, $Q_2$ is not set, but by the opening of the gate $G_2$, the paper feed flip-flop $Q_4$ is again set and the roller 13 is further rotated to further pull out the previously pulled out sheet. Then, the leading end of the sheet strikes against the register rollers 17 to thereby form a loop (slack) in the sheet. Thus, the sheet can be stopped by the register rollers with an appropriate amount of loop maintained in the sheet, thus eliminating the necessity of intricately taking into account the interval between the paper feed roller and the register rollers and also eliminating the necessity of providing any special means in the path, which contributes to compactness of the machine. Also, the loop can be made appropriate and constant and this can reduce jam of sheets as well as ensures stable and accurate registration between the drum image and the sheet to be accomplished by the register rollers 17. Such contrivance is also made in the case of manual supply (as will later be described).

Thereafter, by the closing of the register switch 32, the flip-flop $Q_3$ is energized to operate the rollers 17. The rollers 17 continue to rotate until the start switch 30 is closed next time.

In the case of a preset number of multi-copies, the gate $G_{10}$ is not opened even when one cycle of the process has been terminated and therefore, $Q_3$ is not reset even when the stop switch 35 is closed. Accordingly, the backward movement is continued until $Q_5$ is reset by closing of the start switch 30, whereupon the backward movement is stopped. At the same time, $Q_6$ is again set to start the second forward movement exposure. The gate $G_{10}$ is opened by an END signal provided by each of the signals STB from the stop key 41, paper absence and the cassette absence signals PEP and CEP and a signal CTU indicative of a preset number of copies having been completed. Accordingly, the gate $G_{10}$ controls the outputting of signal HP so that scanning is repeated until a preset number of copy cycles is completed and until an interruption instruction is put out from the stop key or due to paper absence. Also, $Q_4$ is set by signal HP through the gates $G_4$, $G_{25}$, $G_{16}$ and $G_2$ to feed the second and subsequent sheets. Where only one copy is desired, CTU is being put out and therefore, $Q_4$ is not set even if this signal HP is detected. Also, even when the platen starts to move upon depression of the copy button and actuates the switch 35, $Q_4$ is likewise not set.

(Manual Supply Mode)

The manual supply mode will now be described in detail. The operator places a sheet on the bed 12 and urges it toward the rollers 14. First, the detector 15 judges whether or not the sheet has been appropriately inserted. When signal $PS_1$ is generated, timer $Q_9$ is energized to start $T_1$ time limiting operation. Before this $T_1$, the direction of the sheet is corrected and the sheet is caused to strike against the stopped rollers 14 so that the sheet is substantially at a right angle to the rollers 14. That is, for some time after the sheet has been inserted, the attitude of the sheet can be corrected to prevent jam thereof which would otherwise occur due to oblique movement of the sheet after being fed.

When the time $T_1$ has elapsed, the flip-flop $Q_2$ is set through the gates $G_{15}$ and $G_1$. Also, the flip-flop $Q_1$ is set through the gate $G_{27}$. The manual supply input to $G_3$ is 1, since the flip-flop $Q_8$ is set by the switch 15. Also, since the gate $G_2$ is inhibited through an inverter, the driving of the cassette roller 13 is prevented even if signal PF is generated. The drum is rotated by $Q_1$ and the manual supply rollers 14 are rotated by $Q_2$ to introduce the sheet into the apparatus. The sheet arrives at the detector 16 provided behind the rollers 14. Then, the detector generates signal $PS_2$ and the counter $Q_{10}$ starts counting. When the time set by the timer $T_2$ has elapsed and the count is up, $Q_2$ is reset through the gate $G_{23}$ to stop the rollers 14, which thus wait for the next paper feed step. This corresponds to the preparatory paper feed from the cassette in the cassette mode, wherein the preparatory paper feed takes place as aforementioned when the detector 15 detects a manually supplied sheet irrespective of the forward or backward movement of the platen 1.

Also, upon operation of the rollers 14, the prerotation counter $Q_{12}$ is started through the gate $G_{22}$ and after a predetermined rotation, the flip-flop $Q_5$ is set to move the platen leftwardly in the same manner as in the case of the cassette mode and, when the platen strikes against the start switch 30, the forward movement for exposure is started.

Thus, in the manual supply mode, a copy cycle can be entered without closing the copy switch 40, thereby facilitating the operation.

When the switch 31 is closed during the forward movement for exposure, $Q_2$ is again set through the gates $G_{15}$ and $G_1$ to drive the rollers 14, which thus feed the sheet to cause it to strike against the register rollers. When the next switch 32 is closed, $Q_3$ is set in the same manner as in the case of the cassette mode, to rotate the register rollers 17, which thus feed the sheet to the image transfer station.

When the sheet leaves the detector 16, $Q_2$ is reset through an inverter and gate $G_{23}$ to stop the manual supply roller 14 from rotating. This is for the preparation for the feeding of the next sheet.

In the case of the manual supply mode, copying can be started or re-started even if there are generated paper absence, toner absence and overflow signals. In the manual supply mode, several sheets of copies at most are to be produced continuously and thus, even if 1 of TEP and OVF is generated, it will not adversely affect the image or the apparatus. Consequently, this technique sets a value on the simplicity of operation. However, it is possible to effect such a control that when TEP and OVF are 1, start of the copying (the first sheet) is permitted but the subsequent re-start is prevented or the copying is impossible after the first copy is made.

Even if the sheet is momentarily spaced apart from the detector 15 during the time $T_1$ set by the timer $Q_9$, the timer operation can continue and thereby minimize the change of oblique movement of the sheet.

The detectors 15 and 16 are disposed so as to be concerned with separation of sheets and can therefore serve also to position the sheets, and even small sheets such as postcards or the like can be copied at an appropriate position.

Detailed description will now be made of the control of the reversing of the platen in the case of manual supply. In FIG. 7, the signal $PS_2$ of the sheet detector 16 and a predetermined count number signal x from the counter $Q_{14}$ are applied to the input of $G_6$. This is for selecting one of the preset numbers n1 and n3 of the counter $Q_{14}$. That is, the counter $Q_{14}$ judges the size of a sheet as the large size (full) such as A3 or B4 when a sheet is present at the rear counter 16 for a predetermined number of pulses after the count has been started from the registration signal RG, and judges the size of a sheet as the small size (half) such as A4 when a sheet is not present, thereby bisecting the scan stroke. That is, when x is 1 and if 1 is applied to the gate $G_6$ through 0 of PS2, namely, through an inverter, n1 is preset in $Q_{14}$. If the detector 16 is still detecting a sheet when x is 1, 0 is applied to $G_6$ and n3 is preset through an inverter and gate. Accordingly, in the case of manual supply, the counter continues counting until $n_3$ or $n_1$ after x in accordance with the full-size or the half-size sheets, thus putting out a reversing signal BP. Also, if manual supply again takes place during the backward movement, the output of the inverter INV2 will become 0 and so, $G_{10}$ will stop putting out its output and consequently, the switch 35 will not stop the platen but the cycle will continue.

What is important here is that since the sheet has already been fed to the register rollers 17, the timing signal x which senses the sheet detector 16 is a pulse number smaller than $n_1$ of A4 size and also is a timing generated before completion of the stroke corresponding to A4 size.

In this manner, the size data of manually supplied sheets can be sequentially judged at the interval between the process sequence controls without such data being applied in advance in any manner and this can contribute to the sequence control and simplify the circuit arrangement.

In the case of the cassette mode or in the case of the continuous multicopy operation, it is desired to increase the speed to the utmost and to set strokes corresponding to various copy sizes and therefore, three different presets are effected as shown, whereas in the case of the manual supply mode, the desired number of copies is several sheets at most and therefore, two different stroke modes suffice. In this manner, the control mode in the case of the manual supply is simplified as much as possible to reduce the trouble to the utmost.

Description will now be made of the copy interruption instruction in the cassette mode. Re-start by the copy key is prevented by PEP, TEP, CEP and OVF. Before completion of the multicopy operation, the gate $G_{18}$ puts out a signal END by stop key STB signal and PEP and LEP signals to inhibit the gate $G_{14}$ and prevent the subsequent preparatory operation of the paper feed roller 13. Accordingly, the multicopy operation is interrupted. In the case of the stop key, copying is restarted with the copy key ON. By TEP and OVF, the multicopy operation is not interrupted but is completed.

It is also possible to divide the sense timing of the detector 16 in the manual supply mode into $x_1 \ldots x_n$ and effect the sense to thereby effect various stroke controls and it is also possible to set a preset number different from that in the cassette mode in $Q_{14}$.

When a sheet from the cassette or a manually supplied sheet has jammed, jam signal JAM is applied to the R ports of $Q_1$–$Q_6$ and $Q_8$ to deenergize all the clutches and main motor without waiting for the completion of the process.

The flip-flop $Q_8$ for setting the manual supply mode is reset by the reversing signal BP or the jam signal JAM. Also, during the time that the platen moves backwardly after completion of the exposure, manual supply or sheet pick-up from the cassette by the copy key 40 can be effected to enable quick re-start of the copying. By causing the timer $Q_9$ to be started by the AND of the inverted toner absence signal from $G_{21}$ and the detection signal $PS_1$, the manual supply copying can be prevented when OVF and TEP are 1.

As described above, when the manual supply copying is started, the setting of $Q_4$ which drives the cassette roller 13 is inhibited by the set output of $Q_8$, so that the cassette mode is not entered even if the copy key 40 is depressed. However, when the manual supply mode exposure is terminated, $Q_8$ is reset by BP signal and thus, the inhibition of $Q_4$ is released. Accordingly, sheet pick-up from the cassette can be effected by the copy key 40 before the platen comes to its rest position. Consequently, mode change-over can be achieved a little early.

Also, when a manually supplied sheet is inserted while copying is being repeatedly executed in the cassette mode, the setting of $Q_4$ is inhibited and $Q_2$ is set, so that the cassette mode copying is interruped and the manual supply copying is carried out preferentially. If the copy key 40 is again depressed after termination of the manual supply copying, the remaining number of copies will be completed.

During the time that copying is being repeated in the cassette mode, it is also possible to inhibit manual supply until the BP signal for the last copy is generated and this can be accomplished by applying another $\overline{CTU}$ signal to the gate $G_2$.

Figure 10:
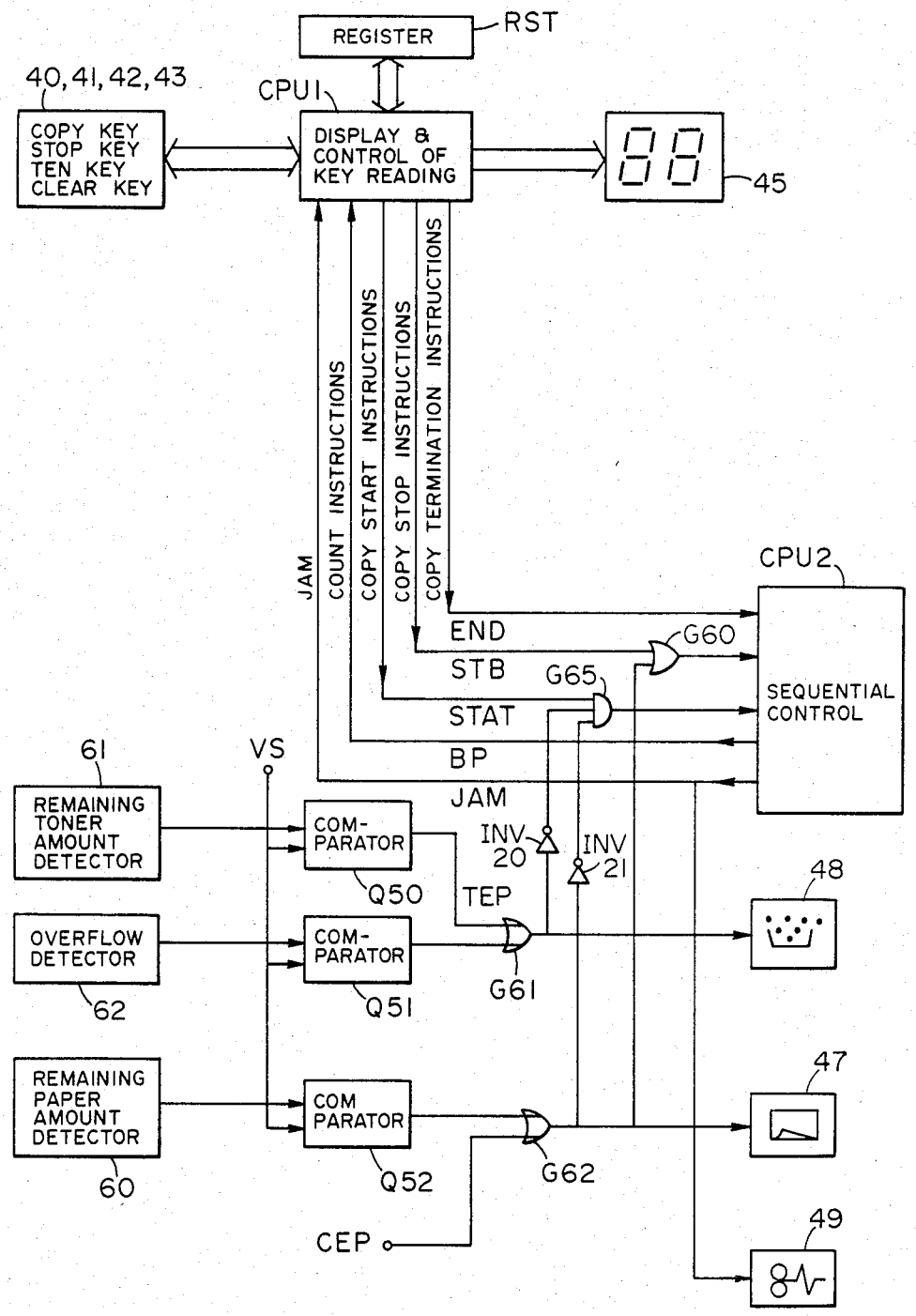
FIG. 10 is a diagram of an example of the display control circuit in the apparatus of FIG. 1.

FIG. 10 shows an example of the circuit for displaying toner absence and overflow. Designated by $Q_{50}$–$Q_{52}$ are operational amplifiers for detecting toner absence, overflow and paper absence, respectively. These operational amplifiers put out their outputs by comparing their detection results with a standard voltage $V_s$. An element 61 judges the toner level in the developer container from the presence or absence of toner intervening between a lamp and a light-receiving member (CdS), and puts out TEP when the quantity of light received exceeds a predetermined level. An element 62 uses a lamp and a light-receiving member and detects toner in the same manner as the element 61 and puts out OVF when the quantity of light received is below the predetermined level. An element 60 puts out PEP in the same manner as the element 61 when the quantity of light received exceeds the predetermined level. $G_{60}$–$G_{62}$ designate OR gates, $G_{65}$ denotes an AND gate, and INV 20–21 designate inverters. $CPU_1$ controls the start, stop and movement of a control unit $CPU_2$ which applies the signals of the ten keys, stop key, copy key and clear key of the operating portion, effects the display operation of the displayer 45, causes the copy preset number by the ten keys to be stored in a register RST (memory) and controls the process sequence.

Operation will now be described. When the toner in the developing device becomes decreased during the copying, signal TEP is put out from the operational amplifier $Q_{50}$. That signal is applied through the gate $G_{61}$ to the toner absence displayer 48, which is thus turned on to give a warning. At the same time, that signal OFF-controls the gate $G_{65}$ through an inverter. Accordingly, even if an attempt is made to re-start the copying by depressing the copy key after the termination of the copying, the copying cannot be re-started because STAT signal is OFF. However, the stop signal STB is not being controlled by TEP so that the preset number of copies set by the ten key can all be completed even if the lamp 48 is turned on in the course of the copying.

When the toner in the toner collecting container 7 is increased approximately to an overflow condition, signal OVF is put out and like TEP, it controls the starting gate $G_{65}$ through the gate $G_{61}$. At the same time, this is displayed by a displayer which is originally adapted to display toner absence. In this case, the displayer may be caused to effect a display different from TEP which effects turn-on-and-off display. Again in the case of OVF, STB is not controlled but the preset number of copies are completed. The completion of the present number of copies is accomplished by counting the signal BP (the reversed position of the platen) for each copy cycle by the preset number stored in the register RST and putting out the signal END. The copy interruption is such that by operation of the stop key to ON or jam, signal STB is put out and one process cycle during which the stop key is ON is terminated, whereafter the continuation of the next cycle is prevented, and not all of the preset cycle is executed.

Such prevention is effected during cassette absence or paper absence. That is, by the paper absence signal PEP and cassette absence signal CEP, signal STB is put out to $CPU_2$ through the gates $G_{62}$ and $G_{60}$. Thereby, a treatment similar to that in case of the stop key ON is carried out. Also, PEP and CEP cause the same displayer 47 to display that effect. Alternatively, the display contents may be distinguished from each other by causing one to be turned on and off at a predetermined period and causing the other to be statically turned on.

When sheet jam has been detected, signal JAM is put out to turn on or turn on and off the displayer 49. At the same time, the power souces for dangerous load (high voltage, heater, etc.) are switched off. That is, the process cycle is interrupted in the course thereof so that copying for the preset cycle as well as for one cycle may not take place. However, the power source of CPU and RST can be held so that the present number is not cancelled even if the main switch 39 is opened. In the case of such jam, the next process re-start can be accomplished by manually closing a switch which releases the jam and cannot be accomplished simply by depressing the copy key.

In addition, it is possible to put the end signal and the output of sensor 61 or 62 into an and-gate, and put the output thereof into one of the operation amplifiers $Q_{50}$ and $Q_{51}$. By doing so, the toner absence and the overflow can be detected only after the termination of the preset number of copies, and then it is displayed and the resuming operation is stopped.

In this case, the lamp of sensor 61 or 62 can be controlled by the end signal. Additionally, by controlling the WAIT signal with END signal, the display and the resuming operation can be controlled. The method explained in this paragraph is very effective when the sequence, display and resuming operations are all controlled by a computer (e.g. when the circuits of FIG. 10 are all embodied by a computer).

Figure 15:
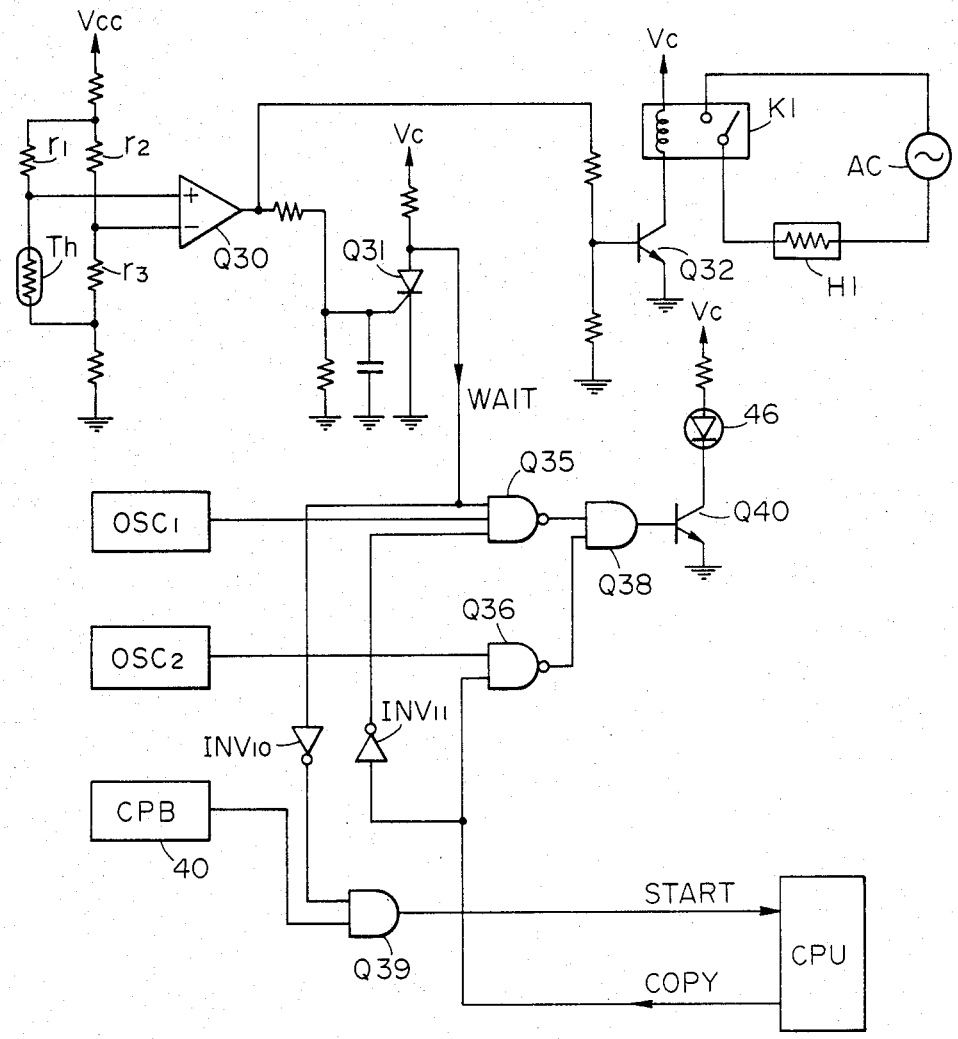
FIG. 15 is a diagram of an example of the display control circuit.

FIG. 15 is a diagram of an example of the circuit which puts out the wait signal WAIT. In FIGS. 15, $r_1$–$r_3$ designate resistors which, with a thermistor Th, constitute a temperature detecting bridge. Q30 designates an operational amplifier which puts out 0 when the temperature of the thermistor Th is below a predetermined temperature and put out 1 when the temperature of the thermistor Th is above the predetermined temperature, namely, the fixing temperature. Q31 is a thyristor electrically energized by the output 1 of the operational amplifier. Q denotes a transistor adapted to be turned on by the output 1 of the operational amplifier to drive a relay K1 for electrically energizing a heater H. AC is an interchangeable power source, and Q35 and Q36 are NAND gates. Q38 designates an AND gate for operatively controlling the wait display lamp 46. Q39 denotes an AND gate which puts out a signal START for starting the copy process. INV10 and INV11 are inverters. Q40 is a transistor for turning on the wait lamp 46. CPU is a copy sequence controller. COPY is a signal indicative of the copying cycle being executed and the time chart thereof is apparent in FIG. 19. OSC1 and OSC2 designate oscillators of different oscillation frequencies which become operative upon closing of the main switch.

Figure 16:
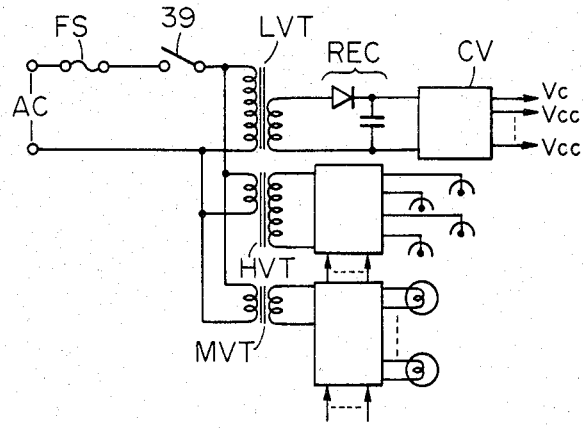
FIG. 16 is a diagram of an example of the power source circuit in the apparatus of FIG. 1.
Figure 17:
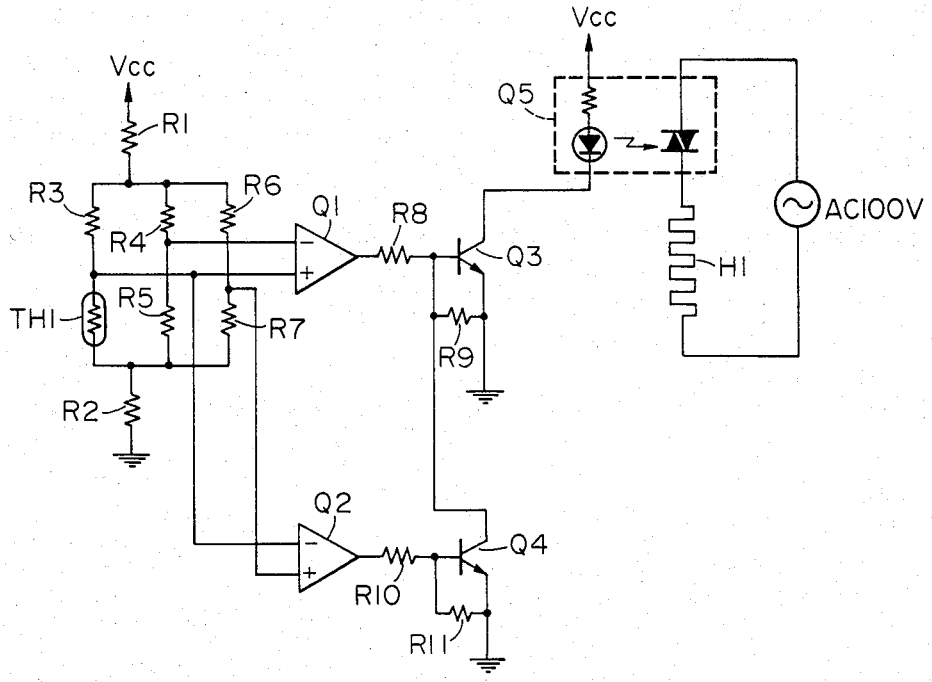
FIG. 17 PRIOR ART
FIG. 17 is a diagram of the temperature control circuit according to the prior art.

FIG. 16 diagrammatically shows an example of the power source circuit. It includes a fuse FS, a low voltage transformer LVT for obtaining controlling source voltages Vc and Vcc, a high voltage transformer HVT for operating the corona charger, a transformer MVT for operating a medium load such as a halogen lamp, a circuit CV for stabilizing the outputs Vc and Vcc, and a rectifier REC.

Operation will now be described. When the main switch 39 is closed, DC voltages Vc and Vcc are put out to render the circuit of FIG. 15 operative. When the temperature of the fixing roller is so low that copying is impossible, the operational amplifier Q30 puts out 0 due to the high resistance of the thermistor Th and the thyristor Q31 maintains its OFF condition and accordingly, the wait signal WAIT is put out by the voltage Vc. On the other hand, the transistor Q32 energizes the relay K1 to heat the heater H1. Consequently, even if the copy key 40 is depressed, sheet feeding and scanning would be prevented from starting by the gate Q39. However, the gate Q35 is receiving as input the signal from the oscillator OSC1 and the copy signal COPY is applying 0 signal and therefore, a signal synchronized with OSC1 is put out to the gate Q38. Since a signal 1 provided by the 0 signal of COPY is being applied to the other input of the gate Q38, the transistor Q40 is turned on and off in synchronism with OSC1 and accordingly, the wait display lamp 46 is turned on and off in synchronism with the period of OSC1. This provides to the operator a warning that the copying is impossible. When the thermistor Th reaches the fixing temperature, the thyristor Q31 is energized by the output of the operational amplifier Q30 and thus, the signal WAIT becomes 0. On the other hand, the relay K1 is deenergized to stop the power supply to the heater H. The output of the gate Q35 becomes 1 and accordingly, by the signal 1 of the gate Q38, the transistor Q40 is statically turned on to turn on the lamp 46. Since one input of the gate Q37 becomes 1, the reception of the copy key is rendered possible and thus, the apparatus waits in the so-called standly condition. In this case, even if the ON-OFF-control of the heater H is effected to maintain the fixing atmosphere at the fixing temperature, the signal WAIT remains to be 0 due to the power supply holding action of the thyristor and therefore, no display malfunctioning occurs.

When the main switch 39 is closed during this standby, the voltages Vc and Vcc become OFF and therefore, in spite of the aforementioned holding action of the thyristor, the power supply to the wait display lamp 46 is cut off to turn off this lamp. Thus, this lamp 46 enables the operator also to judge the power supply condition to the apparatus.

When the main switch 39 is again closed, the thyristor is immediately energized through the operational amplifier because the fixing roller, namely, the thermistor Th is not cold, and as aforementioned, the lamp 46 is statically turned on to bring the machine into standby condition.

When the copy key 40 is depressed during this standby, start signal is put out to CPU to start the operations of the main motor, paper feeding and scanning. CPU puts out copy signal COPY and therefore, the output of the gate Q35 is completely rendered to 1 and a series of pulses of the oscillator OSC2 are put out from the gate Q36. Accordingly, the gate Q38 turns on and off the transistor Q40 in synchronism with OSC2 and consequently, the transistor can turn on and off the lamp 46 at a repetition period longer than that of OSC1. When the scans for a preset number of copies have been terminated and the platen arrives at its reversing position, the signal COPY becomes 0 and therefore, the standby condition is again brought about with the lamp 46 being statically turned on, and thus, the platen becomes ready to receive a copy re-start instruction.

When the copy key is depressed at this time, the same operation as for the previous preset number of copies is re-started without the number of copies being re-set. This re-start is effected in the same manner as the continuous copying wherein even when the platen is returned to its stop position, it is not stopped but is caused to continue to scan.

If the main switch 39 is opened without the copying being re-started, the lamp 46 will be turned off to display that the voltage to the loads such as clutch, main motor, corona charger, etc. has been cut off.

It is also possible that after the main switch 39 has been opened, the amount of power supplied to the lamp 46 is decreased to display the OFF condition thereof. This will be effective for the case where the central control unit CPU remains alive even if the switch 39 is opened, namely, the case where it is desired to continue the memory's operating condition. Particularly, when jam of a sheet is to be dealt with, it is often the case that the main switch 39 is opened and in such case, it is not preferable to cancel the preset number stored in the memory and thus, using said display as the display of the memory ON condition would be very convenient.

Figure 18:
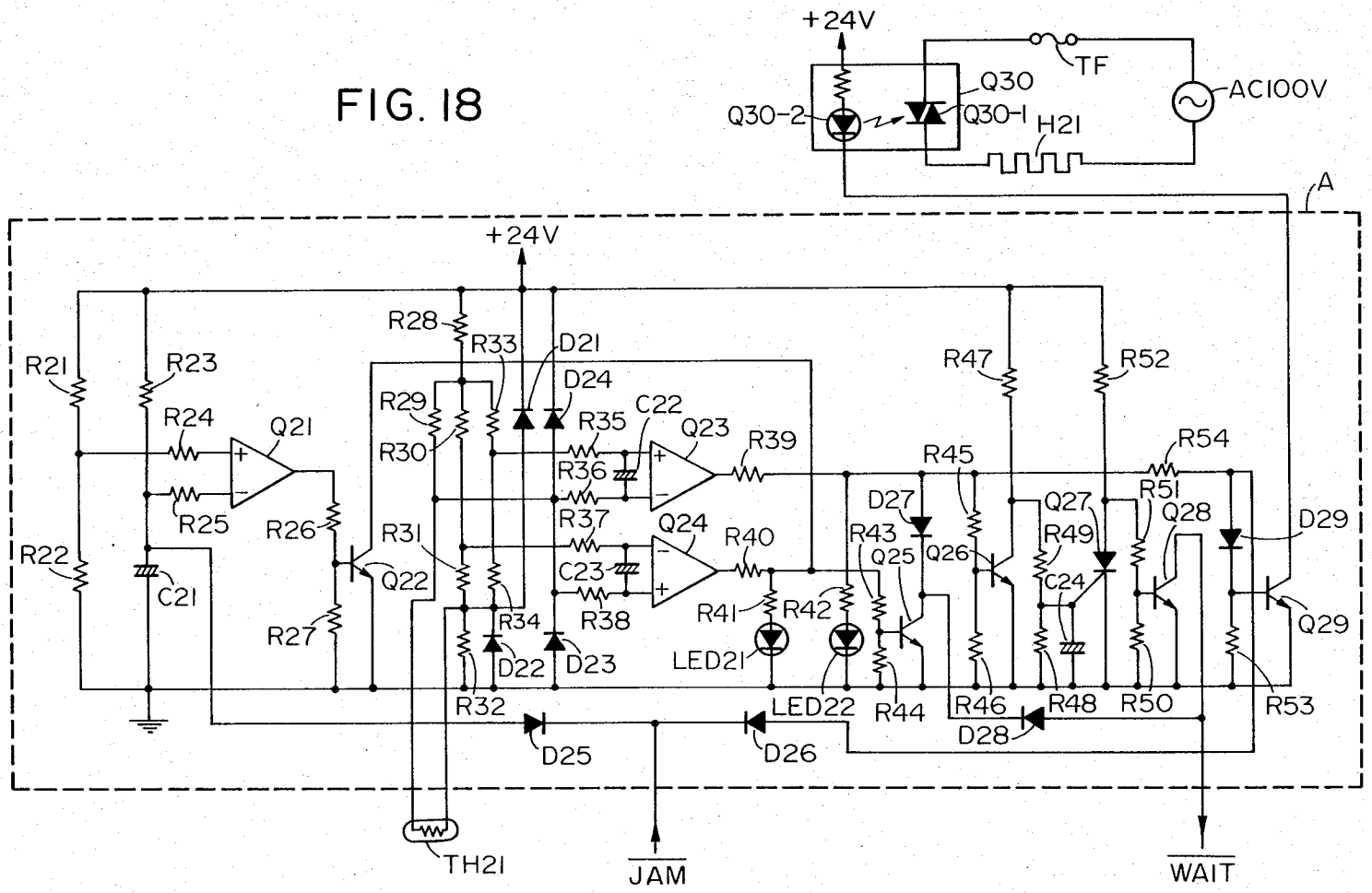
FIG. 18 is a diagram of the temperature control circuit in the fixing device of the FIG. 1 apparatus.

FIG. 18 diagrammatically shows an example of the temperature control disconnection detecting circuit in the present invention. In FIG. 18, H21 designates a heater inserted in the fixing roller 20; TF denotes a temperature fuse adapted to be cut off at a high temperature; Q30-1 is a triac for electrically energizing and deenergizing the heater H21; and Q30-2 is a light-emitting diode for switching on and off the triac Q30-1 and constituting a photothyristor Q30. TH21 designates a thermistor which is in contact with the roller 20; R29, R33 and R34 are resistors forming a bridge with the thermistor TH21; Q23 denotes a temperature controlling operational amplifier; Q29 denotes a transistor for controlling the photothyristor Q30; R28 and R32 are bias setting resistors for operational amplifiers Q23 and Q24; Q26 and Q28 are transistors for effecting wait display; Q27 is a thyristor; R29, R30 and R31 denote resistors for detecting the disconnection of the thermistor TH21; Q24 is an operational amplifier; Q25 is a thermistor; R21, R22, R23, C21 and Q21 are respectively resistors, a capacitor and a transistor constituting a timer for blocking the detection of the disconnection; Q22 is a transistor for putting out a timer output; LED21 and LED22 are light-emitting diodes for monitoring the outputs of the operational amplifiers Q23 and Q24; WAIT is a wait signal for inhibiting the copying; and JAM is a signal which has detected jam of transfer paper on its path by a circuit, not shown.

Operation will now be described.

When the main switch 39 is closed, power is supplied to this circuit, the heater, etc. and immediately after that, the resistance value of the thermistor TH21 is high and therefore, by the bridging with R29, R33 and R34, the output of the operational amplifier Q23 assumes a high level (hereinafter called H). Accordingly, the transistor Q29 is turned on to permit power to be supplied to the heater H21. The transistor Q28 is in its ON state as described later and so, the signal WAIT becomes H to inhibit the start of the copying. When the heater H21 is sufficiently warmed up and the fixing roller 20 reaches the fixing temperature, the resistance value of the thermistor TH21 is lowered below a predetermined level and the output of the operational amplifier Q23 assumes a low level (hereinafter called L), so that the transistor Q26 which has so far been in its ON state is turned off. Accordingly, the thyristor Q27 is triggered by 24 V and turned on, and maintains its ON state. Thus, by the turn-off of the transistor Q28, $\overline{\text{WAIT}}$ becomes H from the wait signal which has so far been H, and a wait completion signal is put out. That is, once the heater reaches its set temperature, the wait completion signal is maintained thereafter independently of the output of Q23. The temperature control of the heater H21 is effected by controlling the triac in accordance with ON-OFF of the output of the operational amplifier Q23 to maintain the surface temperature of the roller 20 constant.

The thermistor disconnection detecting circuit will hereinafter be described. The resistors R30 and R31 are set so as to render the output of the operational amplifier Q24 to H when the thermistor TH21 is 1 MΩ or higher. At the initial stage of closing of the main switch, the capacitor C21 is charged by the time constant of C21 and R23, and the output of the operational amplifier Q21 is H until the voltage of C21 reaches the voltage level set by R21 and R22. Accordingly, during that time, the transistor Q22 becomes L and consequently, there is provided the same effect as the effect of the output of the operational amplifier Q24 having become L and thus, irrespective of the output of the operational amplifier Q24, the transistor Q25 is turned off. Accordingly, the operational amplifier Q23 is not affected through the diode D27 and therefore, the transistor Q29 is turned on and off in accordance with the output of the operational amplifier Q23 to thereby effect temperature control.

When the capacitor C21 is charged and its voltage exceeds the voltage level set by R21 and R22, the operational amplifier Q21 becomes L and the transistor Q22 is turned off. Accordingly, the output of the operational amplifier Q24 becomes H if the thermistor TH21 is in disconnected condition at the time of closing of the main switch, and Q25 is turned on while Q29 is turned off. Consequently, the power to the heater H21 is cut off. Accordingly, it is after the time that the timer comprising R23 and C21 has been up that the output of the operational amplifier Q24 for detecting the disconnection is transmitted to Q25, and by suitably selecting the constant of the timer, the output of Q24 can be transmitted to Q25 after the resistance of the termistor TH21 has been reduced to a sufficiently low value by a rise of the detected temperature. That is, the disconnection of the thermistor is detected when a sufficient time has elapsed after the closing of the main switch so that detection of the disconnection does not take place for some time after the entire apparatus has been left at a low temperature. Accordingly, the thermistor is at a sufficiently low resistance if it is not disconnected after that time, and therefore, the necessity of distinguishing between the high resistance resulting from the disconnection of the thermistor and the high resistance of the thermistor after left at a low temperature is eliminated and consequently, detection of the disconnection becomes exact. Also, during this time, heating is effected irrespective of the disconnection of the thermistor, but abnormal heating does not take place because this time is the inhibition time at the initial stage of closing of the main switch. In the present embodiment, the delay time is one minute and the resistance value of the thermistor which controls the disconnection is 1 MΩ D21–D24 are input protecting clamp diodes; C22, C23 and C24 are noise preventing capacitors; and D25–D29 are come-round preventing diodes.

$\overline{\text{JAM}}$ signal assumes L, for example, when the sheet detector 63 does not detect a sheet at a predetermined time, and turns off Q29 through D26 when an abnormality such as paper jam has occurred within the apparatus, thereby forcibly cutting off the power supplied to the heater H21. The power cut-off is continued unless a reset process is effected and therefore, the temperatures of the heater 21 and thermistor TH21 fall rapidly. Accordingly, the disconnection detecting timer is designed such that it causes discharging to be effected by $\overline{\text{JAM}}$ signal through D25, momentarily effects resetting and operates for said time without fail even after the apparatus has been left inoperative to deal with the jam.

The present embodiment is also applicable to a humidity-removing and warming-up heater provided within the drum, and a sensor such as thermistor or thermocouple for controlling the temperature of a heater utilizing the waste heat of the lamp.

The thermistor in the present example of the circuit may be replaced by a photosensor such as CdS to distinguish between the disconnection of the sensor and the light interception.

Figure 19:
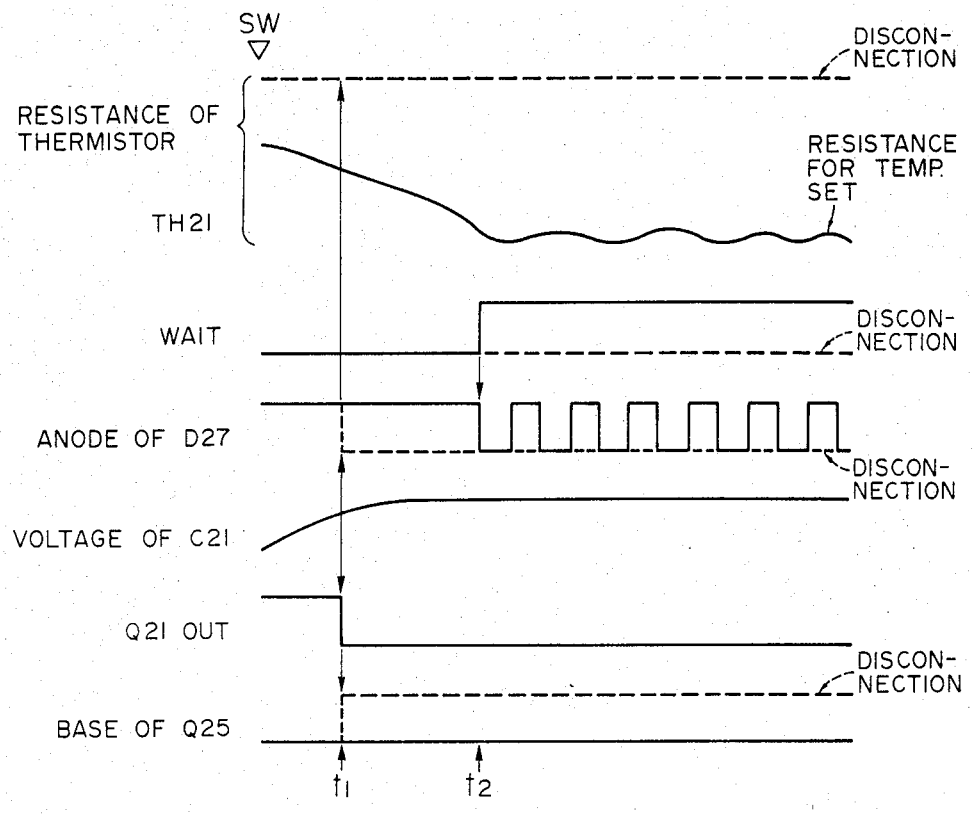
FIGS. 19 and 20 are operation timing charts for the circuits shown in FIG. 18.
Figure 20:
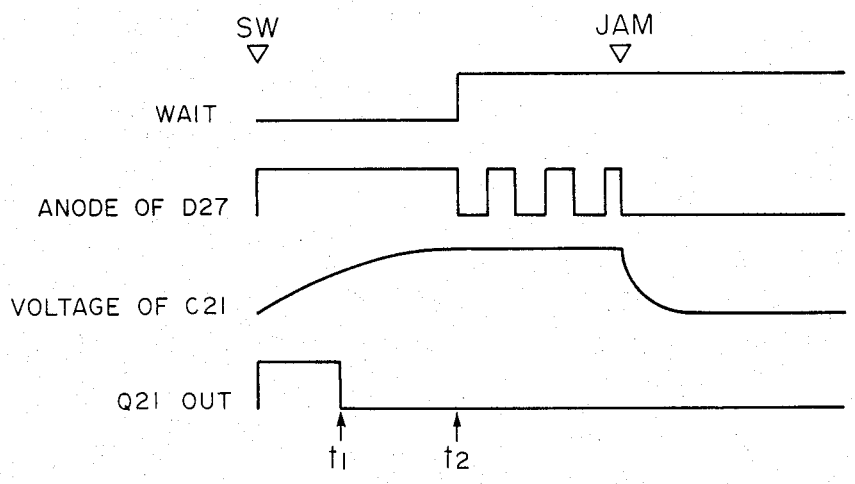

FIGS. 19 and 20 are operation time charts of the FIG. 18 circuit. In FIG. 19, upon closing of the main switch, power is supplied to the heater H21 and the resistance value of the thermistor TH21 gradually decreases. At the same time, the disconnection detection inhibiting timer capacitor C21 is charged. The output of C21 is H. When the capacitor C21 has been sufficiently charged, Q21 becomes L at a time point $t_1$ and the disconnection detecting circuit operates. When there is no disconnection, the base of Q25 remains to be L and so, power continues to be supplied to the heater H21 and accordingly, the resistance value of the thermistor continues to decrease. When the resistance of the thermistor TH21 becomes lower than its set resistance value, $\overline{\text{WAIT}}$ becomes H at a time point $t_2$ and Q23 becomes L. After that, such control is effected that the output of Q23 is switched on and off in accordance with the variation in resistance value of the thermistor TH21 and the resistance thereof is converged to the set resistance value. When there is a disconnection, the base of Q25 becomes H at the time point $t_1$ and the anode of D27 becomes L and the power to the heater H21 is cut off as indicated by dotted line, and the $\overline{\text{WAIT}}$ signal remains to be L, thus preventing the start of the copying.

In FIG. 18, when $\overline{\text{JAM}}$ signal comes in during the temperature control operation, the base of the transistor Q29 is rendered to L through D26 and therefore, the power to the heater H21 is cut off and the charge of the capacitor C21 is discharged.

Also, when the main switch 39 is opened during the temperature control to stop the power supply to the heater and circuit and then the main switch is again closed, it is sometimes the case that the roller has not yet fallen from its predetermined temperature and therefore, during the disconnection detection blocking time by the timer, the roller may be further heated to an excessive temperature in spite of the disconnection. However, due to the discharging resistors (R21, R23, R22) of the capacitor C21, charge is left in the capacitor C21 when the switch 39 has been again closed. Accordingly, the disconnection detection inhibiting time becomes shorter and in the case of the thermistor disconnection, it can be quickly detected to prevent excessive temperature rise. In this case, an amount of charge corresponding to the time from when the switch 39 has been opened until it is again closed is left in the capacitor C21 and thus, the setting of the timer corresponding to the time required for the roller 20 to be cooled down becomes possible.

Description will now be made of the copy sequence control and display control by the thermistor disconnection detection.

Figure 21:
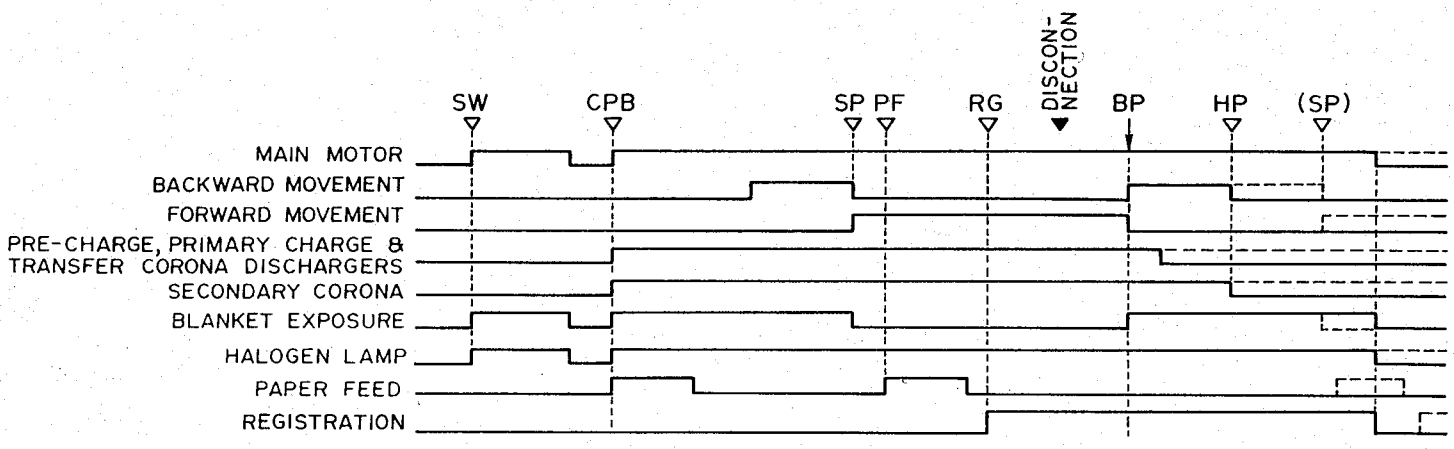
FIG. 21 is a timing chart showing operations during the disconnection of the thermistor in the apparatus of FIG. 1.

FIG. 21 is an operation time chart for the thermistor disconnection detection in the copying apparatus of FIG. 1. In FIG. 21, the high level indicates the operation. Desired copies are obtained by repeating the copying operation (forward and backward movement of the platen) for the number of copies set by the ten keys 42, and the solid lines indicate the case where the thermistor is disconnected during the execution of the process for the first of the multiple copies. The dotted lines indicate the normal case. As is apparent from FIG. 21, when the thermistor is disconnected, the power source is not immediately cut off upon detection thereof, but the first copy is completed and the cleaning of the drum by the post-rotation thereof is effected, and then re-start of the copying is prevented. It is also possible to make such a design that the copying operation is stopped after the copying operation for a predetermined number of copies has been continued and completed, and then re-start of the copying operation is prevented. What has been described above is a measure for not harming the copying speed with the fact taken into account that even if the thermistor is disconnected during the copying operation for some reason or other, temperature does not sharply rise for some time thereafter. That is, if disconnection is detected and the operations of the heater, the main motor, etc. are immediately stopped as when jam has been detected, the sheet now copying would be stopped within the apparatus and extra trouble and time would be required for the removal of such sheet and for the extra next copy compensating for the removed sheet, but such inconvenience can be eliminated by the above-described technique.

The interruption of the copying covers the possibility of cutting off all the power sources and interrupting the copying operation as soon as disconnection is detected, preventing re-start of the next process after the process being executed during the detection of the disconnection has been terminated, and preventing re-start of the process after the preset number of copies have been completed.

Figure 22:
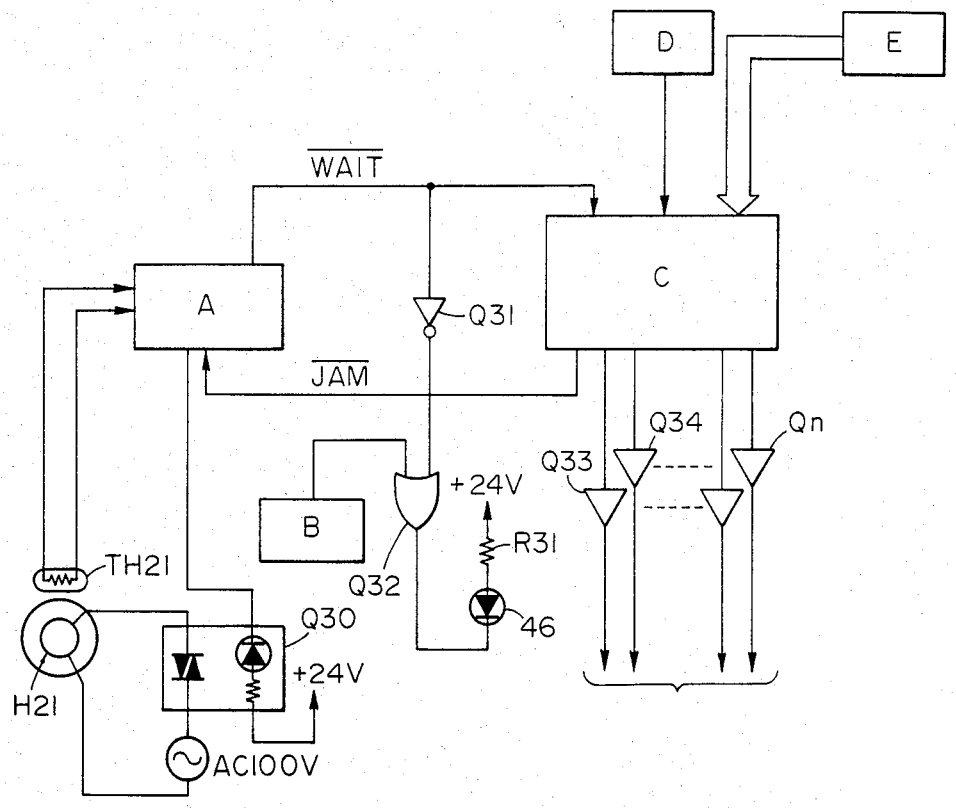
FIG. 22 is a diagram of the sequence display circuit in the present invention.

FIG. 22 is a diagram similar to FIG. 15 and showing the wait (disconnection) display control circuit. In FIG. 22, A designates the temperature control circuit of FIG. 18; B denotes an oscillator for turning on and off the wait displayer 46; C designates a sequence control circuit; D denotes a jam detecting circuit; E designates the keys of the operating portion; Q33, Q34 and Qn are process loads such as the main motor, etc.; and Q31 and Q32 designate an inverter and an OR gate, respectively, for operating the wait displayer 46.

When the main switch is closed, the wait signal WAIT is H as already described and accordingly, the output of Q31 is 0 and consequently, LED46 is turned on and off by the oscillator B through the OR gate, thus displaying that the roller is not yet capable of fixation. At the same time, even if the copy button is depressed, the copying cannot be started. When the roller reaches the fixing temperature, the signal WAIT becomes L as previously described and LED46 is statically turned on to display that the copying is now possible by the depression of the copy key. When the thermistor is disconnected before the start of the copying or during the copying operation and the signal WAIT changes from H to L as previously mentioned, LED46 is changed so as to be turned on and off through the gate Q32. Even if the copy key is then depressed, the copying operation will not be started. If the copying operation is going on, the copy cycle after the disconnection will not be started.

Also, in FIG. 7-1, by the thermistor disconnection detection signal WAIT, the same END signal as that previously described is put out through the diode $D_{30}$ and gate $G_{18}$ even in the course of multicopy. Accordingly, the backward movement of the platen is stopped at the position HP and re-start of the platen is prevented.

What we claim is:

1. An image formation apparatus comprising means for forming an image on a sheet fed thereto, means for heat-fixing the image formed on said sheet by said image formation means, said heat-fixing means including an electrically powered heat source, means for detecting the temperature of said heat-fixing means, temperature control means for controlling the electric power supplied to said heat source in accordance with the detected temperature, means for detecting disconnection of an element in said detecting means for detecting the temperature of said heat-fixing means, malfunction detecting means for detecting a malfunction condition in said apparatus, interruption means for interrupting operation of said apparatus in accordance with an output of said malfunction detecting means, and control means for operating said disconnection detecting means after a predetermined time from a point in time when said apparatus restarts operation after release from the malfunction.

2. An image formation apparatus according to claim 1, wherein said control means has means for varying said predetermined time for a disconnection detection delay in accordance with the time during which said fixing means is inoperative.

3. An image formation apparatus according to claim 1 wherein said means for forming an image includes a rotatable photosensitive member.

4. An image formation apparatus according to claim 3, being capable of forming an image on multiple sheets to thereby perform a multisheet copying operation, said apparatus further comprising control means responsive to detection by said disconnection detecting means of disconnection of said element in said detecting means during a continuous multisheet copying operation to cause image forming operation on a given sheet in progress when said disconnection is detected to be completed, thereafter to cause cleaning of said photosensitive member by a post-rotation thereof, and after termination of said post-rotation to inhibit restart of the image forming operation on sheets subsequent to said given sheet.

5. An image formation apparatus according to claim 4, wherein said malfunction detecting means includes means for detecting a jam of a sheet, and wherein said interruption means includes means responsive to detection of a jam by said jam detecting means to interrupt image forming operation on said jammed sheet without waiting for termination of the image forming operation on said jammed sheet.

6. An image formation apparatus comprising process means for forming an image on a sheet fed thereto, a heated member having a heat source disposed within said apparatus and adapted to heat upon supply of electric power thereto, means for detecting the temperature by said heat source, temperature control means for controlling the electric power supplied to said heat source in accordance with the detected temperature, means for detecting disconnection of an element in said detecting means for detecting the temperature by said heat source, malfunction detecting means for detecting a malfunction condition in said apparatus, interruption means for interrupting operation of said apparatus in accordance with an output of said malfunction detecting means, and control means for operating said disconnection detecting means after a predetermined time from a point in time when said apparatus restarts operation after release from the malfunction condition.

7. An image formation apparatus comprising a main switch for enabling said apparatus and initiating a preparatory operation for image formation, process means for forming an image on a recording sheet, a heat source disposed within said apparatus and adapted to heat upon supply of electric power thereto, a temperature detecting element for effecting the temperature control of said heat source, means for detecting disconnection of said temperature detecting element, said disconnection detecting means having comparing means for comparing the output signal of said temperature detecting element with a reference signal to detect the disconnection, wait means for causing the preparatory operation for image formation to take place after closing of the main switch of said apparatus and for displaying that the apparatus is in its preparatory condition, said wait means having a wait displayer, and control means for operating said wait means by said disconnection detecting means to display the disconnected condition and for preventing start of the image formation by said process means.

8. An image formation apparatus according to claim 7, wherein said control means turns off the display of said wait means when the detected temperature reaches a predetermined temperature after the closing of the main switch, and turns on said display when disconnection is detected.

9. A temperature control device comprising a heated member having an electrically powered heat source, means for detecting the temperature of said heated member, temperature control means for controlling the electric power supplied to said heat source in accordance with the detected temperature, means for detecting disconnection of an element in said detecting means for detecting the temperature of said heated member, interruption means for interrupting operation of said temperature control means in accordance with a malfunction condition detection signal, and control means for operating said disconnection detecting means after a predetermined time from a point in time when said temperature control means restarts operation after release from the malfunction condition.

10. A temperature control device according to claim 9, wherein said control means has means for varying said predetermined time for a disconnection detection delay in accordance with the down-time from the stoppage of heating.

* * * * *